US012312793B1

(12) United States Patent
Eshaq

(10) Patent No.: US 12,312,793 B1
(45) Date of Patent: May 27, 2025

(54) PORTABLE CHILD SEAT BIDETS

(71) Applicant: Luai Eshaq, Alberta (CA)

(72) Inventor: Luai Eshaq, Alberta (CA)

( * ) Notice: Subject to any disclaimer, the term of this patent is extended or adjusted under 35 U.S.C. 154(b) by 185 days.

(21) Appl. No.: 18/337,398

(22) Filed: Jun. 19, 2023

Related U.S. Application Data

(60) Provisional application No. 63/353,296, filed on Jun. 17, 2022.

(51) Int. Cl.
*E03D 9/08* (2006.01)
*A47K 13/06* (2006.01)
*A47K 13/10* (2006.01)

(52) U.S. Cl.
CPC ..... *E03D 9/08* (2013.01); *A47K 13/06* (2013.01); *A47K 13/105* (2013.01)

(58) Field of Classification Search
CPC ..... E03D 9/08; A47K 13/105; A47K 13/06
See application file for complete search history.

(56) References Cited

U.S. PATENT DOCUMENTS 3,808,608 A * 5/1974 Caplan ..... E03D 9/085 4/448
5,279,001 A * 1/1994 Vento ..... A47K 13/005 4/420.4
7,818,824 B2 * 10/2010 Honsa ..... A47K 13/06 4/420.3

* cited by examiner

*Primary Examiner* — Christine J Skubinna
(74) *Attorney, Agent, or Firm* — Miller IP Law; Devin Miller

(57) ABSTRACT

Described herein are examples of portable child seat bidets. The bidets may be sized to fit onto a normal adult-sized toilet and may include handles, seat back, a seat frame, a pump a battery-powered pump assembly, a liquid container (vessel), and a bidet assembly in fluid connection with the pump assembly. A power button/switch can be included on the pump assembly or may be positioned onto one of the handles and wirelessly connected to the pump. When connected to the vessel and turned on, the pump assembly creates pressure inside the vessel, causing water to spray out through a nozzle of the bidet housing assembly. The bidets may include various features for assisting fit with various size adult toilet seats.

20 Claims, 30 Drawing Sheets

PORTABLE CHILD SEAT BIDETS

CROSS-REFERENCE TO RELATED APPLICATIONS

The present application is a continuation of U.S. Non-Provisional Patent Application No. 63/353,296 entitled "PORTABLE CHILD SEAT BIDETS", filed on Jun. 17, 2022. The entire contents of the above-listed application are hereby incorporated by reference for all purposes.

BACKGROUND

Toilets, in various forms, are found in nearly every household and business place across the country and are used to assist people with human waste disposal. Often, waste is removed via plumbing to a sewer or septic tank system. Bidets or toilet paper commonly used for cleaning oneself off after use of a toilet. Toilet seats can have a variety of shapes, sizes, and features. Most toilets are adult sized, however, relatively smaller sized toilets for children are available, as well as, portable seats used for children that can fit into or on top of a regularly sized adult toilet seat.

BRIEF DESCRIPTION OF THE DRAWINGS

The present description will be understood more fully when viewed in conjunction with the accompanying drawings of various examples of the portable child seats bidets. The description is not meant to limit the portable child seats bidets to the specific examples. Rather, the specific examples depicted and described are provided for explanation and understanding of portable child seats bidets. Throughout the description the drawings may be referred to as drawings, figures, and/or FIGs.

DETAILED DESCRIPTION

Figure 1:
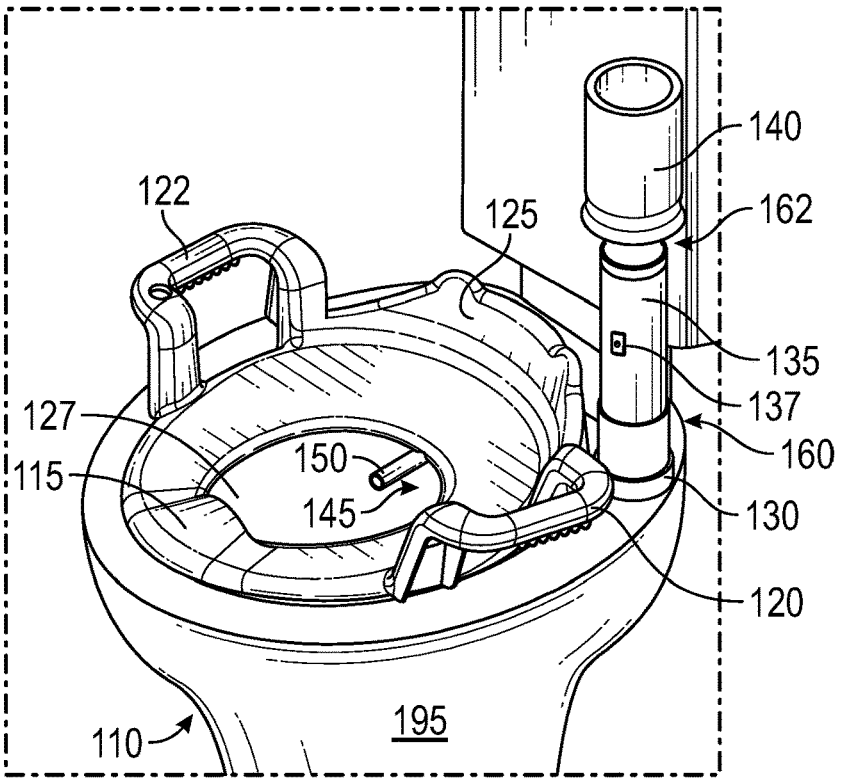
FIG. 1 illustrates a portable child seat bidet according to an embodiment.

A portable child bidet seat as disclosed herein will become better understood through a review of the following detailed description in conjunction with the figures. The detailed description and figures provide merely examples of the various embodiments of portable child bidet seats. Many variations are contemplated for different applications and design considerations; however, for the sake of brevity and clarity, all the contemplated variations may not be individually described in the following detailed description. Those skilled in the art will understand how the disclosed examples may be varied, modified, and altered and not depart in substance from the scope of the examples described herein.

A conventional toilet generally has a seat that is too large for use by a child. Child-sized seats which fit onto a conventional toilet may be used so that a child can sit on the toilet. Smaller, child-sized training potties also exist, but they typically must be manually emptied and are not connected to a plumbing system.

Traditionally, toilet paper or a bidet is used after an individual is finished with a bowel movement to clean off residual fecal matter. However, toilet paper may be difficult to reach for a child using a child toilet seat. Further, children of a relatively young age often struggle with efficiently and effectively cleaning themselves using toilet paper alone, by themselves.

Bidets are a frequently used alternative to toilet paper. Traditional bidets are typically affixed to a toilet in a position to help a user of the toilet clean themselves after a bowel movement. Although some bidets may be repositionable or may have a range of movement or rotation, traditional bidets do not account for a user sitting on a child seat.

Further, traditional bidets are typically connected to the same plumbing system as the toilet, to provide a water source for the bidet nozzle and are not portable from one toilet to another.

Traditional child toilet seats are sized to fit in or on a traditional toilet seat, are typically portable, and may therefore be transported for use with toilets at differing locations. However, traditional child toilet seats do not come equipped with toilet paper or with a bidet. Thus, there exists a need for a product that allows children to use any adult sized toilet while providing access to a bidet that can be used to facilitate cleaning.

Implementations of portable child seats bidets described herein overcome some or all of these problems by providing a portable child seat that has a bidet assembly incorporated thereon which does not require connection to plumbing. Instead, a battery-operated pump is used to generate water pressure, and a portable, removably attachable vessel is used to contain the water.

The vessel may be filled from a sink or from another container having water in it and then attached to the portable child toilet seat. Embodiments of the pump are battery powered. The entire child seat bidet is portable and may therefore be used with any conventional, adult-sized toilet.

FIG. 1 illustrates a portable child seat bidet 110 according to an embodiment. The child seat bidet 110 includes a seat frame 115 having handles 120 (first handle), 122 (second handle), a seat back 125, a central aperture 127, and a port 130; a pump assembly 135 having a power switch 137; a vessel 140; and a bidet housing assembly 155 having a nozzle 150.

As shown, the pump assembly 145 may include a first end 160 that is inserted into the port 130 and a second end 162 onto which the vessel 140 is attached. The vessel 140 may contain liquid which is pumped by the pump assembly 135 through the port 130, into the bidet housing assembly 155, and out from the nozzle 150. The pump housing assembly 155 may provide adequate water pressure for cleaning.

The pump assembly 135 may be battery powered, and the vessel may be prefilled or filled prior to use. Embodiments of the child seat bidet can be portable, not requiring a separate power source or plumbing connection, and may be taken anywhere to provide a child bidet, even if there is no power source or plumbing.

The child seat bidet 100 can fit onto a regular sized adult toilet 195, such as by having an outer perimeter of a bottom portion of the child seat bidet configured to match the inner perimeter of a toilet seat onto which the child seat bidet may be placed. The handles 120, 122, and back 125 may be shaped to facilitate carrying or transporting the child seat.

In some embodiments, one or more of the handles 120, 122 and seat back 125 may be omitted or otherwise shaped or sized. In one embodiment, the port 130 extends from a radial portion of the seat frame 115 located between one of the handles 120, 122 and the seat back 125. The port 130 may also be otherwise positioned or sized without departing from the scope of this disclosure. For example, the port and pump assembly may be otherwise shaped, such as by both being square or rectangular in cross-section as opposed to round and cylindrical, or any other shape.

Figure 2:
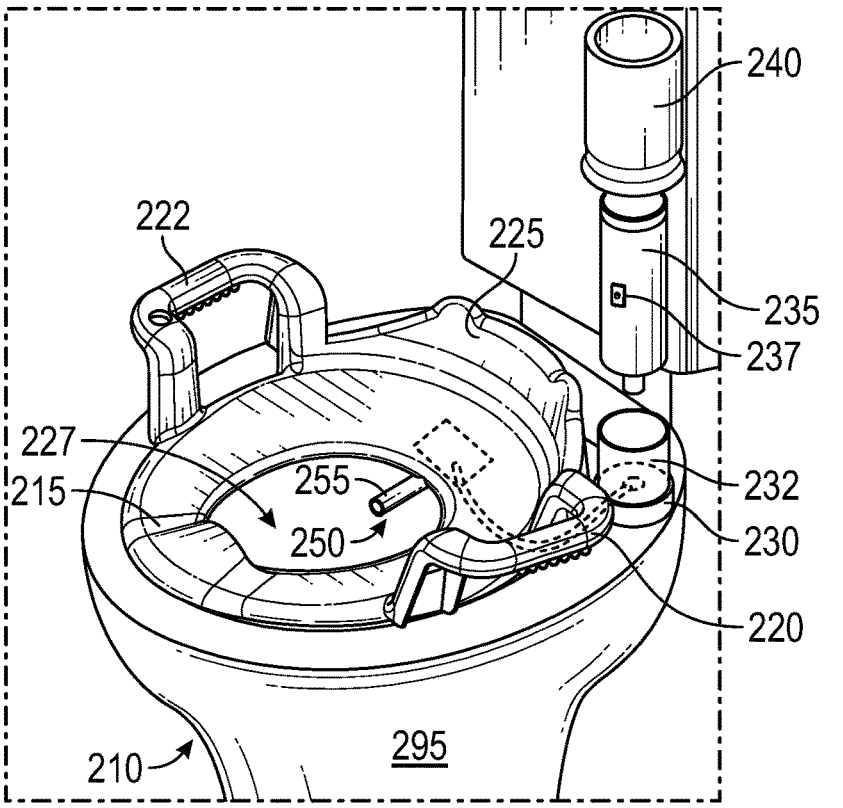
FIG. 2 illustrates a portable child seat bidet, according to an embodiment.

FIG. 2 illustrates a portable child seat bidet 210 according to an embodiment. The child seat bidet 210 includes a seat frame 215 having handles 220, 222, a seat back 225, and a port 230 having a port cavity 232; a pump assembly 235 having a power switch 237; a vessel 240; and a bidet assembly 245 having a nozzle 250, tubing 276, and bidet housing assembly 255.

Embodiments of the switch 237 may be positioned on the handle 220, 222.

Embodiments of the port and pump assembly may be otherwise configured, such as the port having a male end and the pump assembly comprising a female end or cavity.

As shown, the tubing 276 connects the port 230 and the nozzle 250. The pump assembly 235 and attached vessel 240 may be removably inserted into the port 230. Thus, the vessel 240 is in fluid connection with the nozzle 250. This allows for the vessel to be removed, refilled, and reconnected to the pump assembly for multiple uses.

Figure 3:
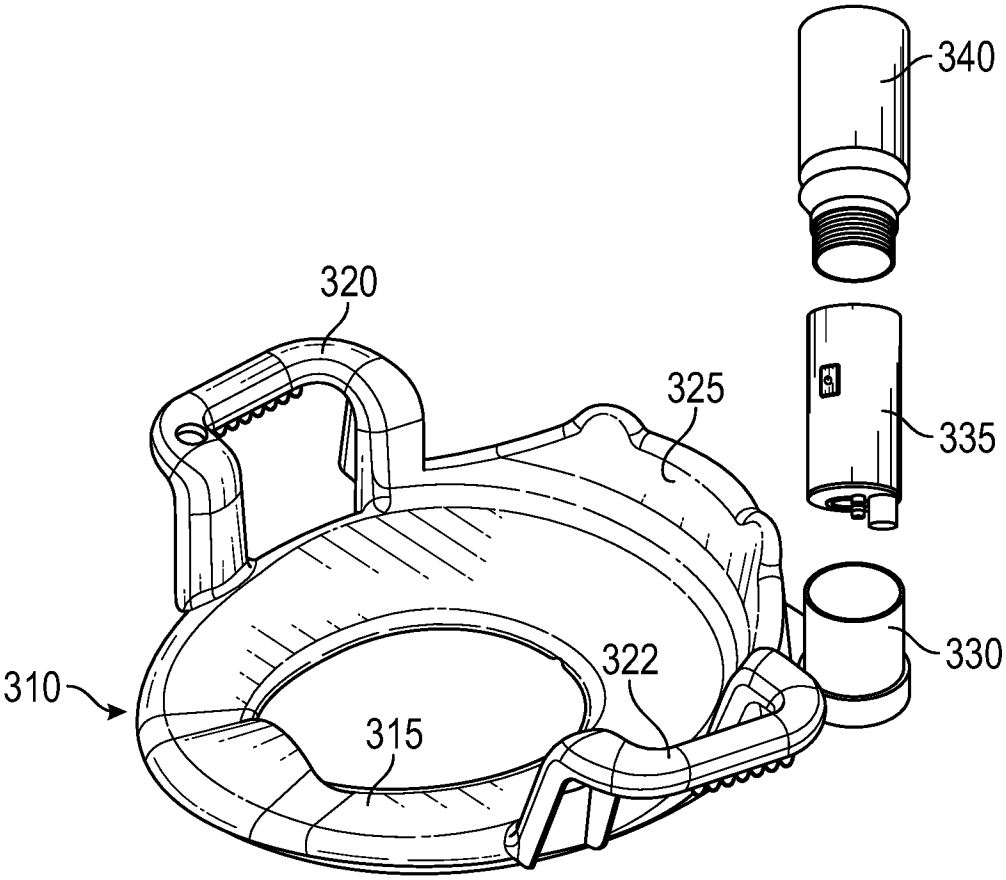
FIG. 3 illustrates a portable child seat bidet, according to an embodiment.

FIG. 3 illustrates a portable child seat bidet, according to an embodiment. The child seat bidet 310 includes a seat frame 315, handles 320, 322, a seat back 325, a port 330, a pump assembly 335, and a vessel 340.

As shown, the pump assembly 335 and vessel 340 can be detached from each other and from the other components of the child seat bidet.

Figure 4:
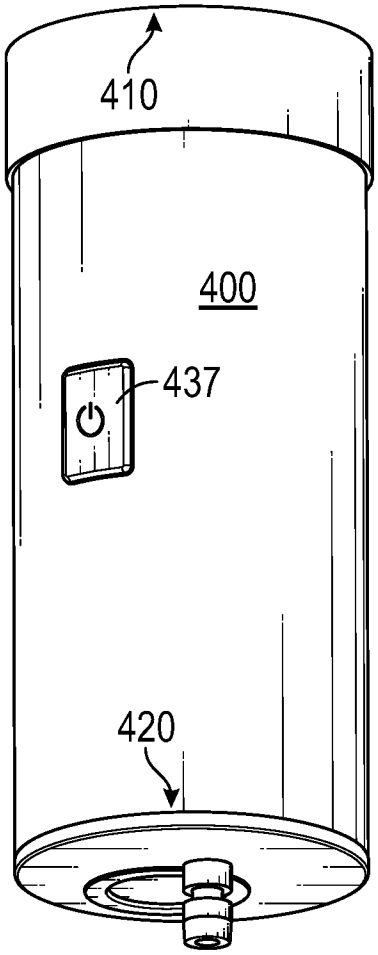
FIG. 4 illustrates a side view of a bidet pump according to an embodiment.

FIG. 4 illustrates a side view of a bidet pump assembly 400 according to an embodiment. The embodiment disclosed in FIG. 4 illustrates a cylindrical bidet pump assembly including a power switch or button 437, a bidet pump assembly first end 410, and a bidet pump assembly second end 420. As shown, a bidet pump assembly first end portion proximate the first end of the pump assembly has a slightly wider radius to accommodate a first end of a vessel which may be attached thereto, and apertures to allow for air flow into and liquid flow out of the vessel. The bidet pump assembly second end also includes apertures for allowing liquid and air to pass through. By pressuring the vessel with air from an intake of the pump assembly, water inside the vessel is forced through the outtake of the pump assembly. The power switch may be used to selectively activate the pump to control a stream of liquid from the spout of the bidet. In some embodiments, the port 230 may include features to engage the air intake and liquid outtake and allow flow there though. For example, the liquid outtake may include a male end which is inserted into a feature of the port, such as a hole matching the size of the male end. The bidet assembly tubing may connect through the feature to receive liquid from the liquid outtake and supply it to the spout of the bidet.

Figure 5:
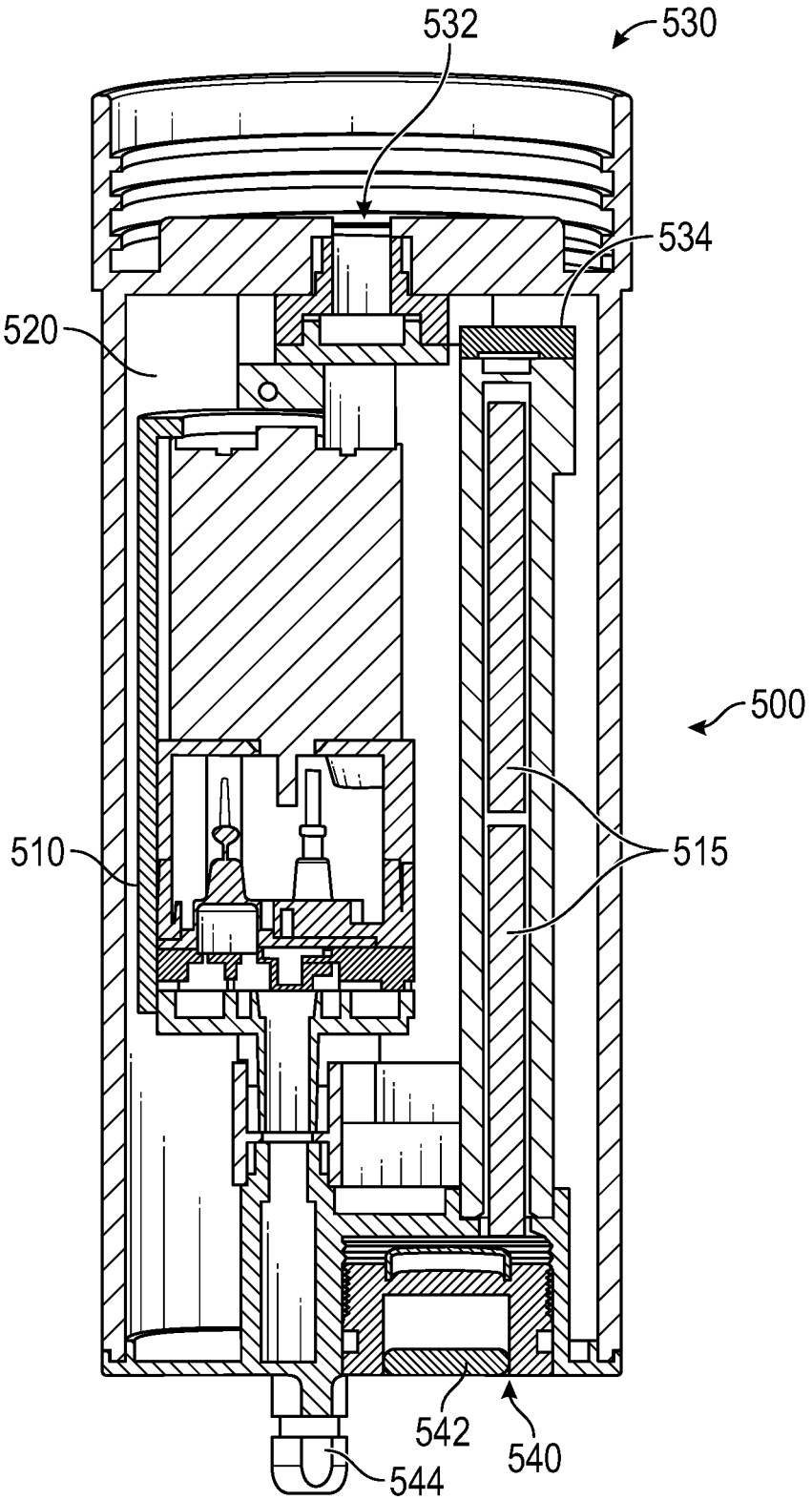
FIG. 5 illustrates a cross section of a bidet pump, according to an embodiment.

FIG. 5 illustrates a cross section of a bidet pump assembly 500, according to an embodiment. The bidet pump assembly 500 includes a pump 510, battery assembly 515, a cavity 520, a bidet pump assembly threaded first end 530 having a liquid intake 532 and an air outtake 534, and a bidet pump assembly second end 540 having an air intake 542 and a liquid outtake 544. When the pump assembly 500 is turned on, the pump 510 pulls air through the air intake 542, pumps the air through the air outtake 534 and into a liquid vessel attached to the threaded first end 530, causing liquid inside the vessel to enter the liquid intake 532 and exit the liquid outtake 544. Although threaded ends are depicted in the pictured embodiment, it will be appreciated by one of ordinary skill in the art that any suitable structure of connecting the vessel and pump assembly may be acceptable.

Figure 6:
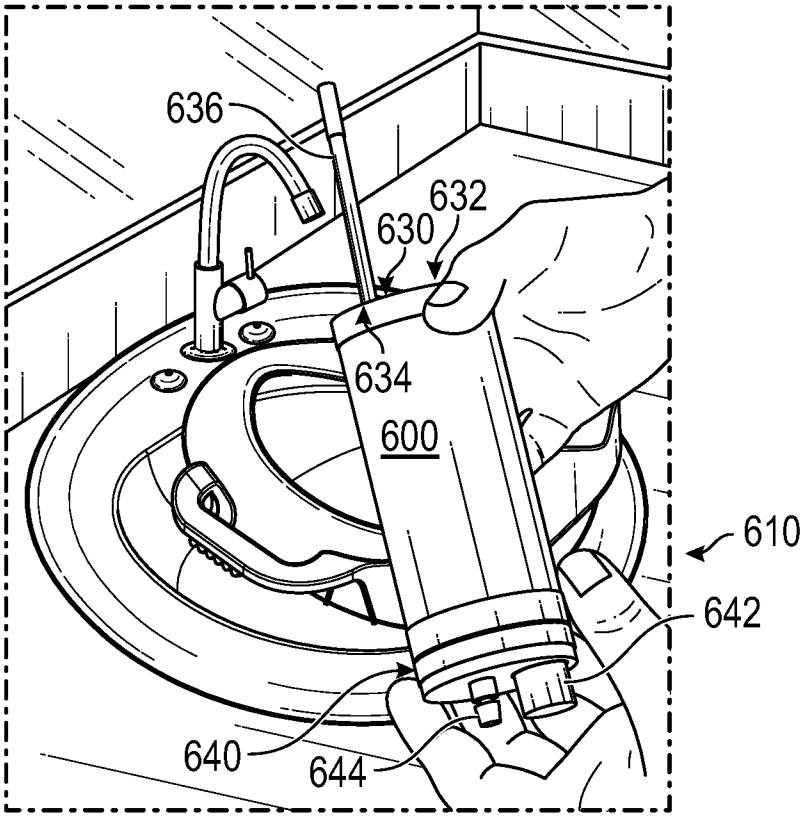
FIG. 6 illustrates a bidet pump, according to an embodiment.

FIG. 6 illustrates a bidet pump assembly 600, according to an embodiment. The bidet pump assembly 600 includes a threaded first end 630 having a liquid intake 632 and an air outtake 634 with a hose 636 attached thereto, and a second end 640 having a small hole at the top of the assembly near the pump and a liquid outtake 644. The pump assembly 600 further includes a pump assembly anchor 642 configured to engage a port aperture securing the pump assembly to the port and seat frame. When the pump assembly 600 is turned on, an interior pump pulls air through the small hole at the top of the assembly near the pump, pumps the air through the air outtake 634 and into a liquid vessel attached to the threaded first end 630, causing liquid inside the vessel to enter the liquid intake 632 and exit the liquid outtake 644. The port can include a port bottom portion, wherein the port bottom portion includes a port first aperture, wherein the port first aperture is configured to anchor the port to the seat frame and receive the pump assembly anchor. A port second aperture, wherein the port second aperture is configured to engage the pump assembly liquid outtake and receive water from the pump assembly liquid outtake.

Figure 7:
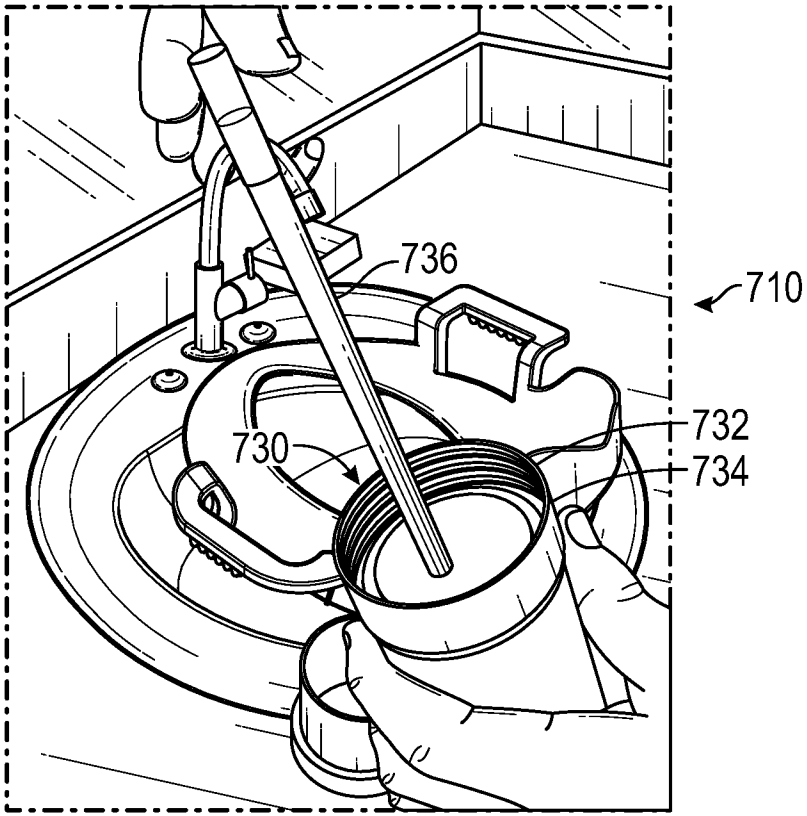
FIG. 7 illustrates a bidet pump, according to an embodiment.

FIG. 7 illustrates a bidet pump assembly 700, according to an embodiment. The bidet pump assembly 700 includes a threaded first end 730 having a liquid intake 732 and an air outtake 734. As shown, a tube 736 extends out from the air outtake 734. The tube 736 may have a length slightly less than the height of a vessel to which the assembly may be attached, such that the vessel end of the tube is near a back of the vessel when the vessel is attached to the pump assembly. The pump assembly hose can extend from the pump assembly air outtake into the vessel, and the pump assembly hose can be configured to push air into the vessel and push water into the pump assembly water intake.

Figure 8:
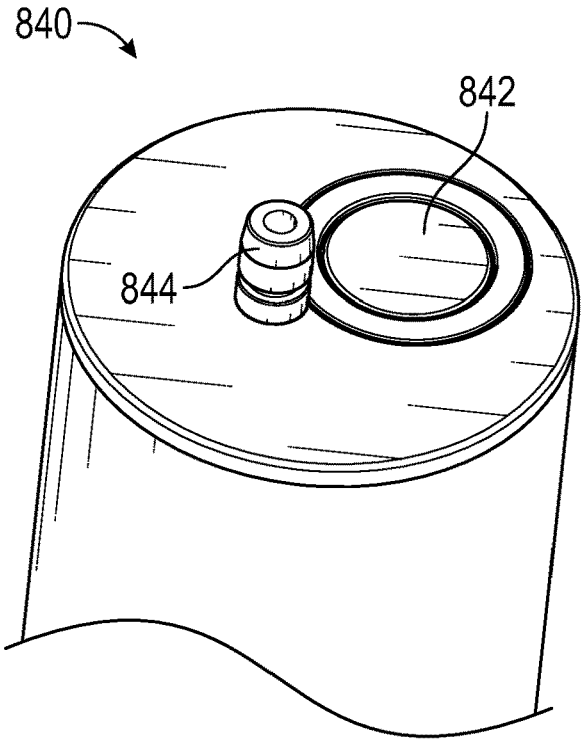
FIG. 8 illustrates a first end portion of a bidet pump, according to an embodiment.

FIG. 8 illustrates a second end portion 840 of a bidet pump assembly 800 (bidet pump assembly second end portion 840), according to an embodiment. As shown, a liquid outtake 844 and a battery gate 842 are disposed on the second end portion 840. In some embodiments, the liquid outtake 844 may be received by associated features of the port to facilitate flow therethrough. The air intake receives air from exterior to the pump assembly and vessel and pumps the air into the vessel to create sufficient pressure for a stream of water to flow out from the liquid outtake 844 and through the nozzle of the bidet assembly.

Figure 9:
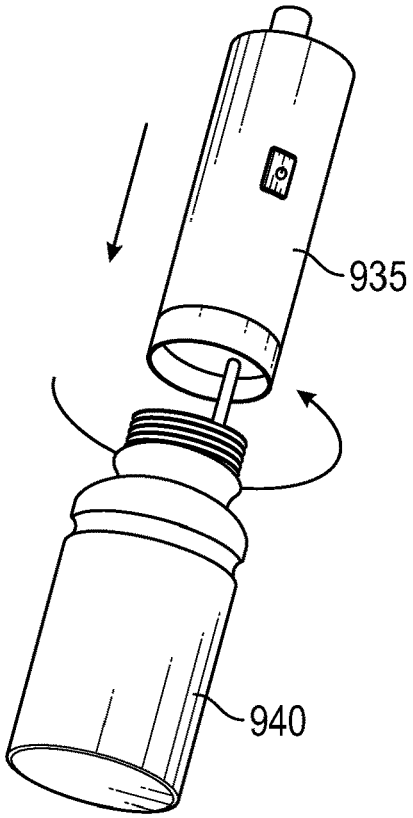
FIG. 9 illustrates a bidet pump and liquid container, according to an embodiment.

FIG. 9 illustrates a bidet pump and liquid container (vessel), according to an embodiment. As shown, the bidet pump assembly 935 and vessel 940 (or liquid container) may include threaded ends for removable attachment, such that liquid from the vessel may flow into the pump assembly. The attachment may be substantially watertight to minimize spillage. A tube 976 (or hose) extends from the air outtake of the pump assembly into the vessel 940, such that the end of the tube 976 that is inside the vessel 940 is near an end of the vessel 940 opposite the threaded opening. This allows air to enter the vessel 940 while preventing liquid from entering the air intake and causing air and pressure to accumulate inside the vessel 940 when the pump assembly 935 is turned on.

Figure 10:
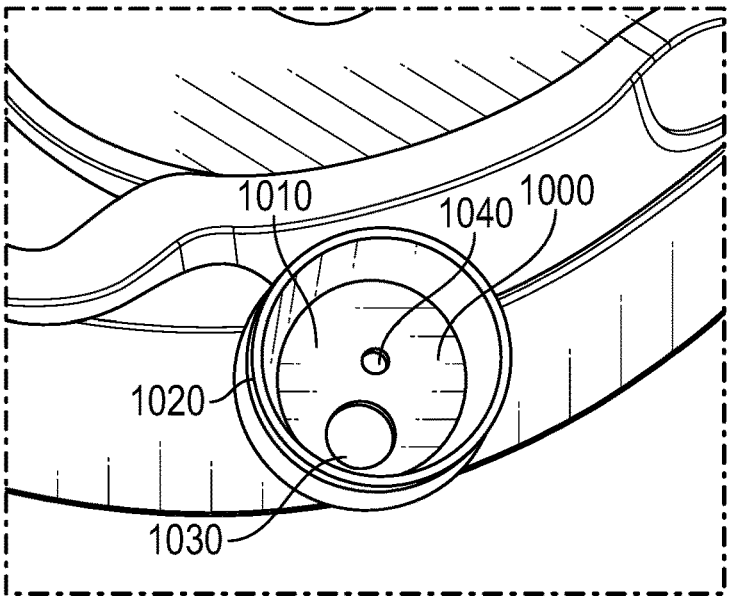
FIG. 10 illustrates a bidet port, according to an embodiment.

FIG. 10 illustrates a bidet port 1000, according to an embodiment. The bidet port 1000 includes a port bottom portion 1010 and port cylindrical wall portion 1020 extending upwards from the bottom portion 1010. The port bottom portion 1010 has a port first aperture 1030 and a bidet port second aperture 1040. The bidet port first aperture 1030 can be an anchor for the bidet assembly. The bidet port second aperture 1040 is sized to match the liquid outtake of a pump assembly that is inserted into the port. The bidet port second aperture 1040 may have bidet assembly tubing 1076 attached thereto, such that liquid from the liquid outtake of a pump assembly may pass through the bidet port second aperture 1040 and through tubing to be sprayed from a nozzle of the bidet assembly.

Figure 11A:
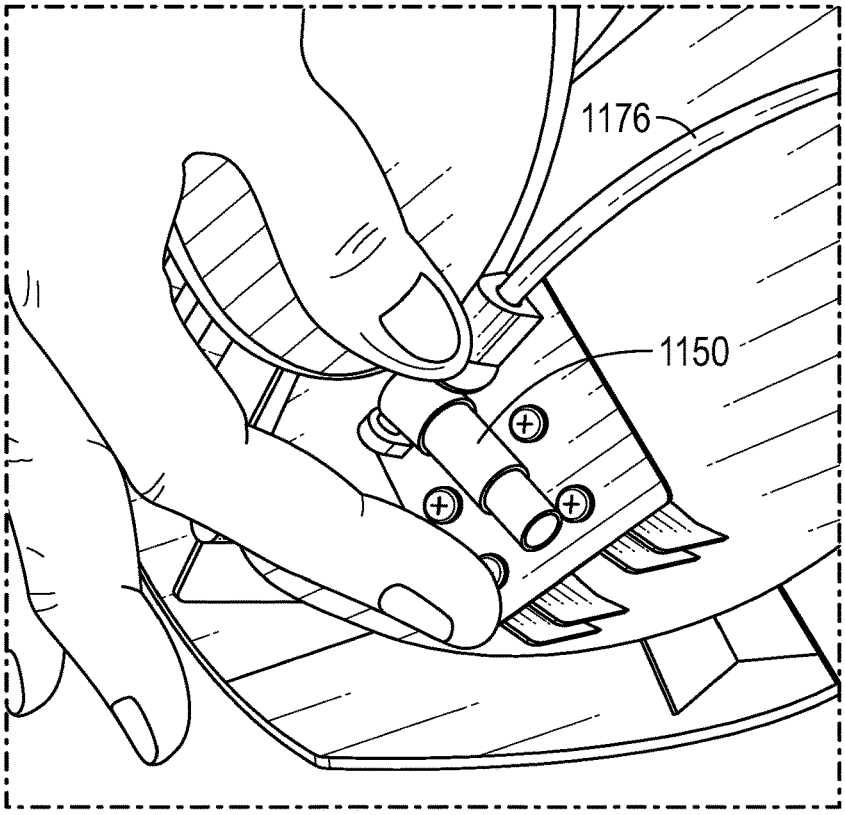
FIG. 11*a* illustrates a bidet spout in a first configuration, according to an embodiment.

FIG. 11*a* illustrates a bidet spout or nozzle 1150 of a child seat bidet 1100 in a first configuration, according to an embodiment. As shown, the nozzle 1150 is part of a bidet housing assembly 1155 which is configured to connect to the seat frame. The nozzle 1150 can be positioned to rest against an underside of the seat frame and is connected to tube 1176 as shown. The bidet housing assembly can be configured to receive the tubing from the port, be mounted on the underside of the seat frame, and allow the nozzle to rotate vertically in an arc of 180°.

Figure 11B:
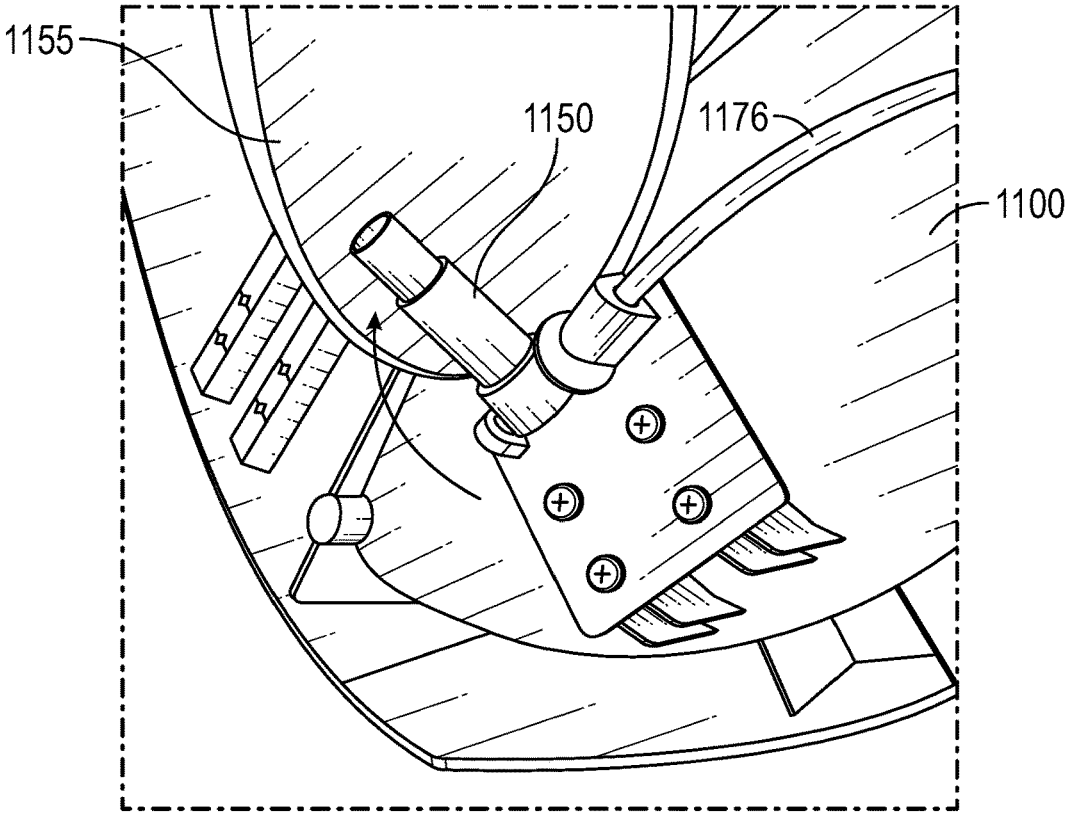
FIG. 11*b* illustrates a bidet spout in a second configuration, according to an embodiment.

FIG. 11*b* illustrates a nozzle 1150 in a second configuration, according to an embodiment. As shown, the nozzle 1150 can be redirected across a wide angle of rotation.

Figure 12:
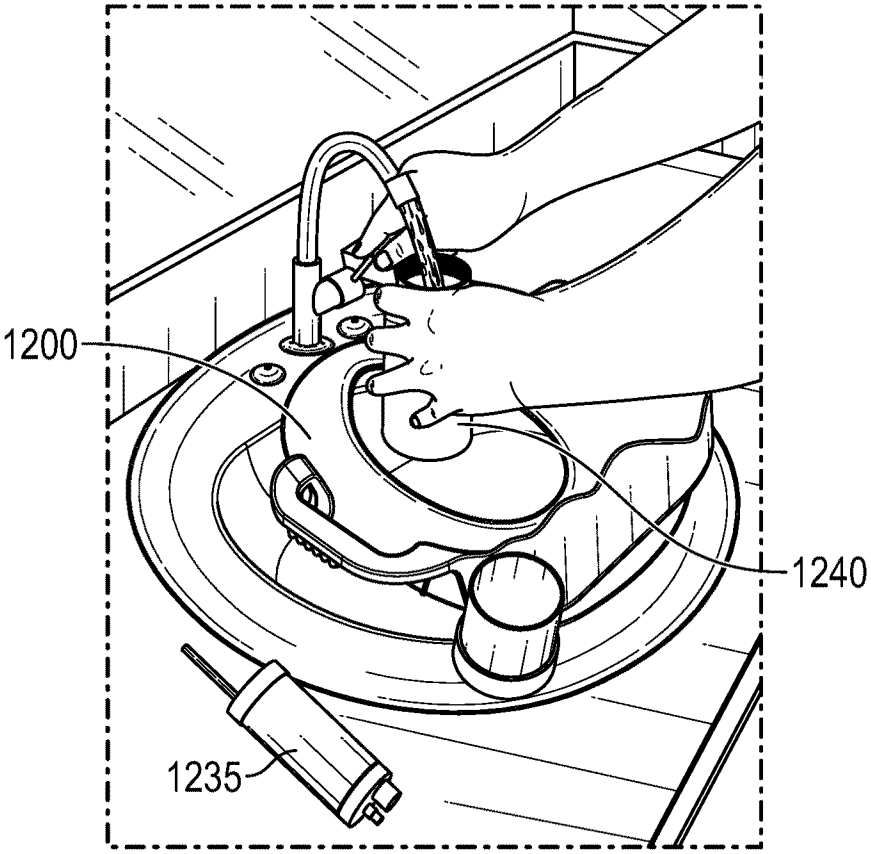
FIG. 12 illustrates a portable child seat bidet, according to an embodiment.

FIG. 12 illustrates a portable child seat bidet 1200, according to an embodiment. As shown, one stage of using the child seat bidet 1200 may comprise filling the vessel 1240 with liquid.

Figure 13:
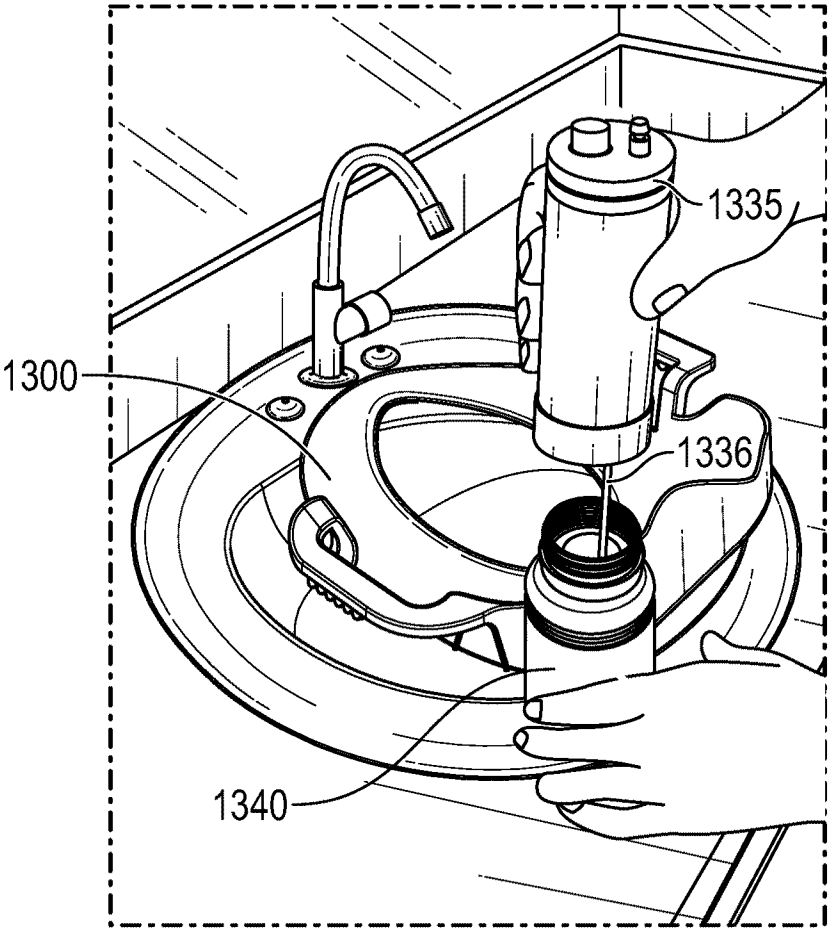
FIG. 13 illustrates a portable child seat bidet, according to an embodiment.

FIG. 13 illustrates a portable child seat bidet 1300, according to an embodiment. As shown, one stage of using the child seat bidet 1300 may comprise inserting a hose 1336 of the pump assembly 1335 into the vessel 1340.

Figure 14:
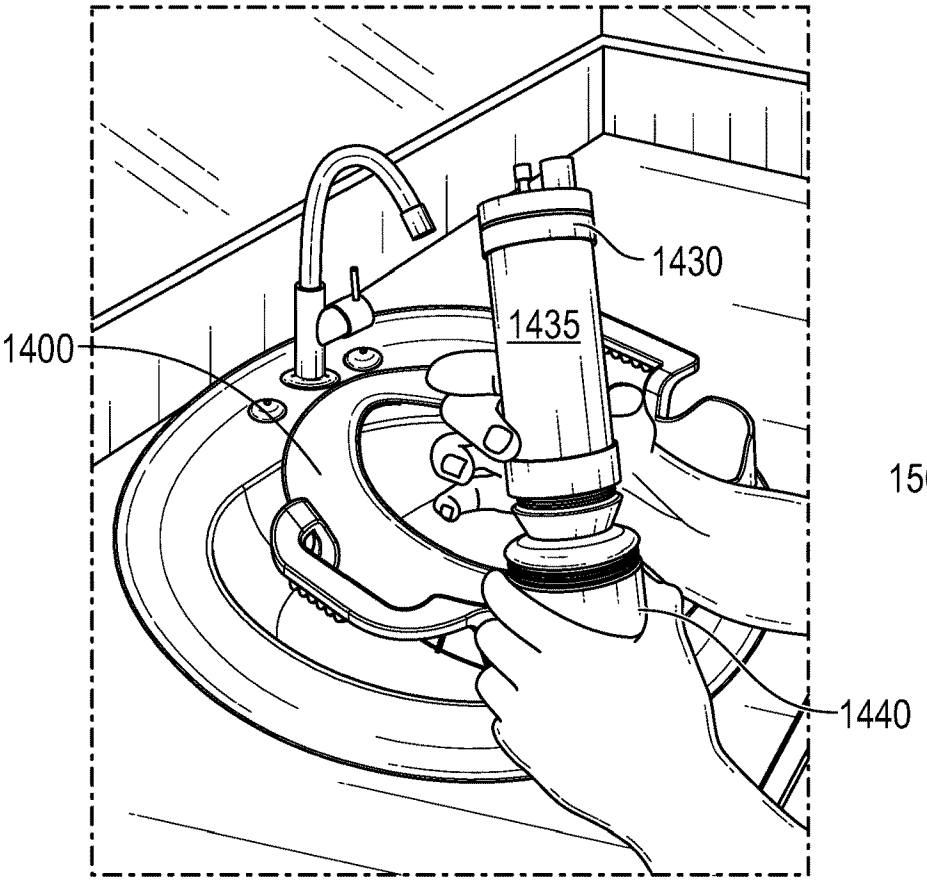
FIG. 14 illustrates a portable child seat bidet, according to an embodiment.

FIG. 14 illustrates a portable child seat bidet 1400, according to an embodiment. As shown, one stage of using the child seat bidet 1400 may comprise screwing the vessel 1440 or rotating the vessel 1440 on to the pump assembly 1435.

Figure 15:
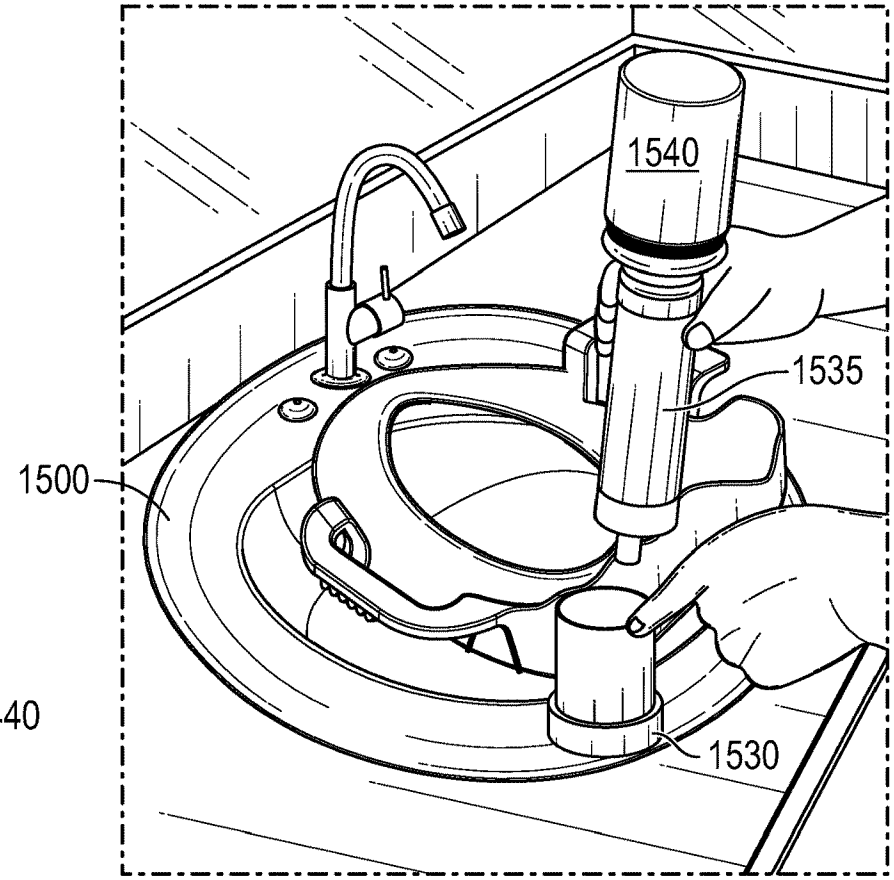
FIG. 15 illustrates a portable child seat bidet, according to an embodiment.

FIG. 15 illustrates a portable child seat bidet 1500, according to an embodiment. As shown, one stage of using the child seat bidet 1500 may comprise inserting the pump assembly 1535 with the vessel 1540 attached into the port 1530 of the portable child seat bidet 1500.

Figure 16:
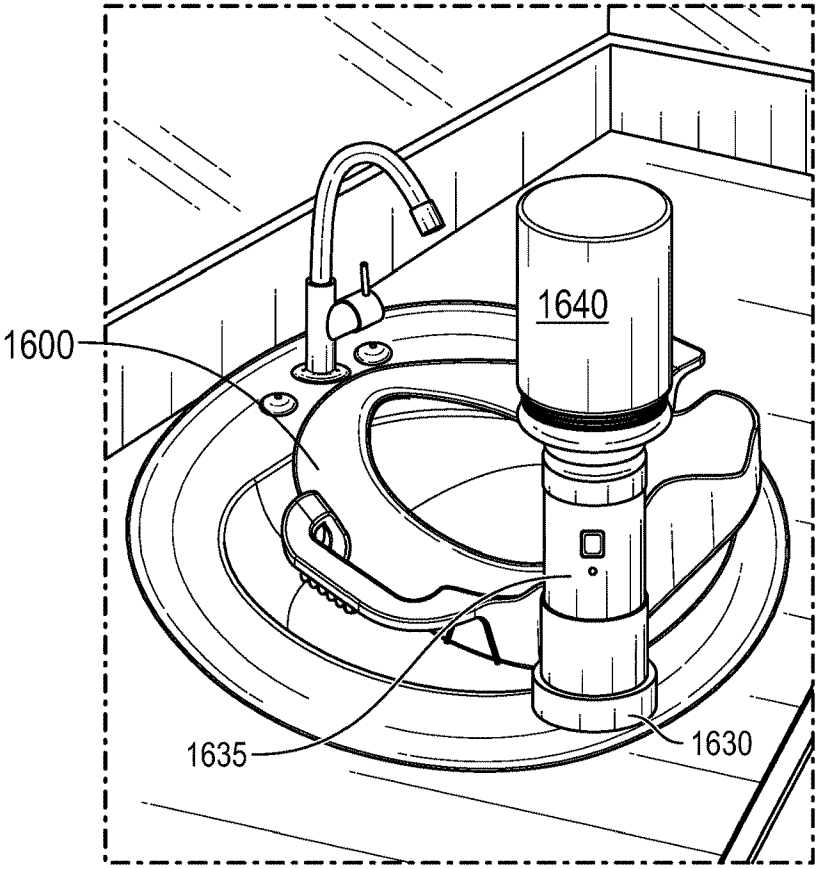
FIG. 16 illustrates a portable child seat bidet, according to an embodiment.

FIG. 16 illustrates a portable child seat bidet 1600, according to an embodiment. As shown, one stage of using the child seat bidet 1600 may comprise having the pump assembly 1635 with the vessel 1640 attached inserted into the port 1630 of the child seat with the pump assembly turned off.

Figure 17:
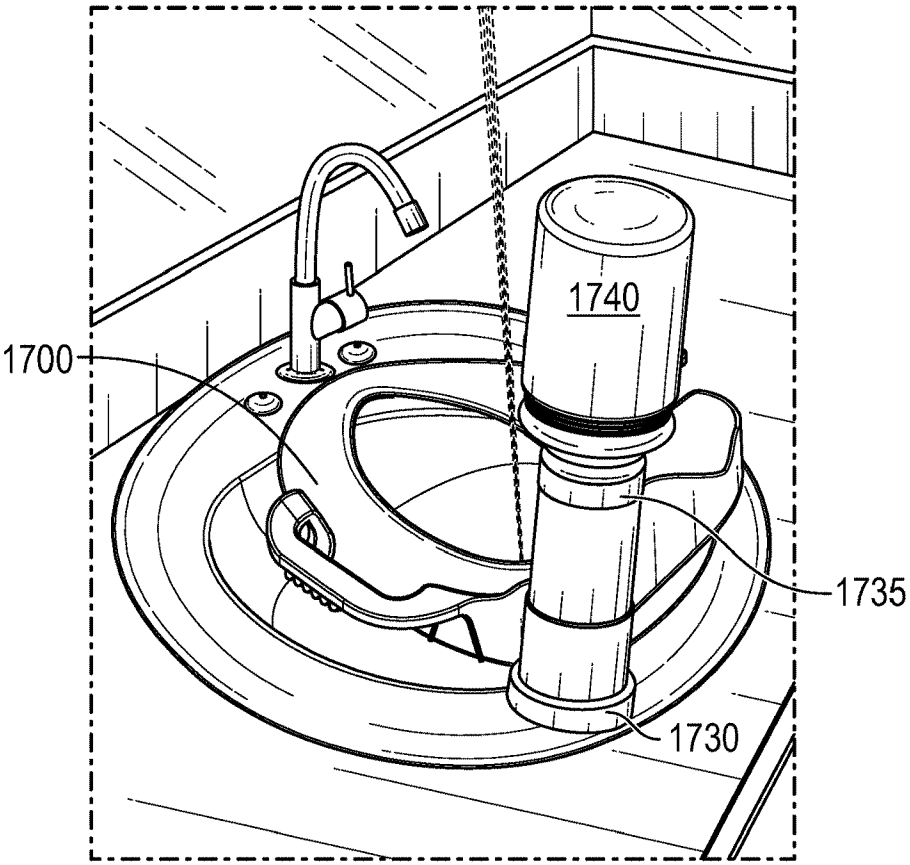
FIG. 17 illustrates a portable child seat bidet, according to an embodiment.

FIG. 17 illustrates a portable child seat bidet 1700, according to an embodiment. As shown, one stage of using the child seat bidet 1700 may comprise having the pump assembly 1735 with the vessel 1740 attached inserted into the port 1730 of the child seat with the pump assembly 1735 turned on and the spout 1750 angled at a suitable angle for using water from the vessel 1740 for self-cleaning.

Figure 18:
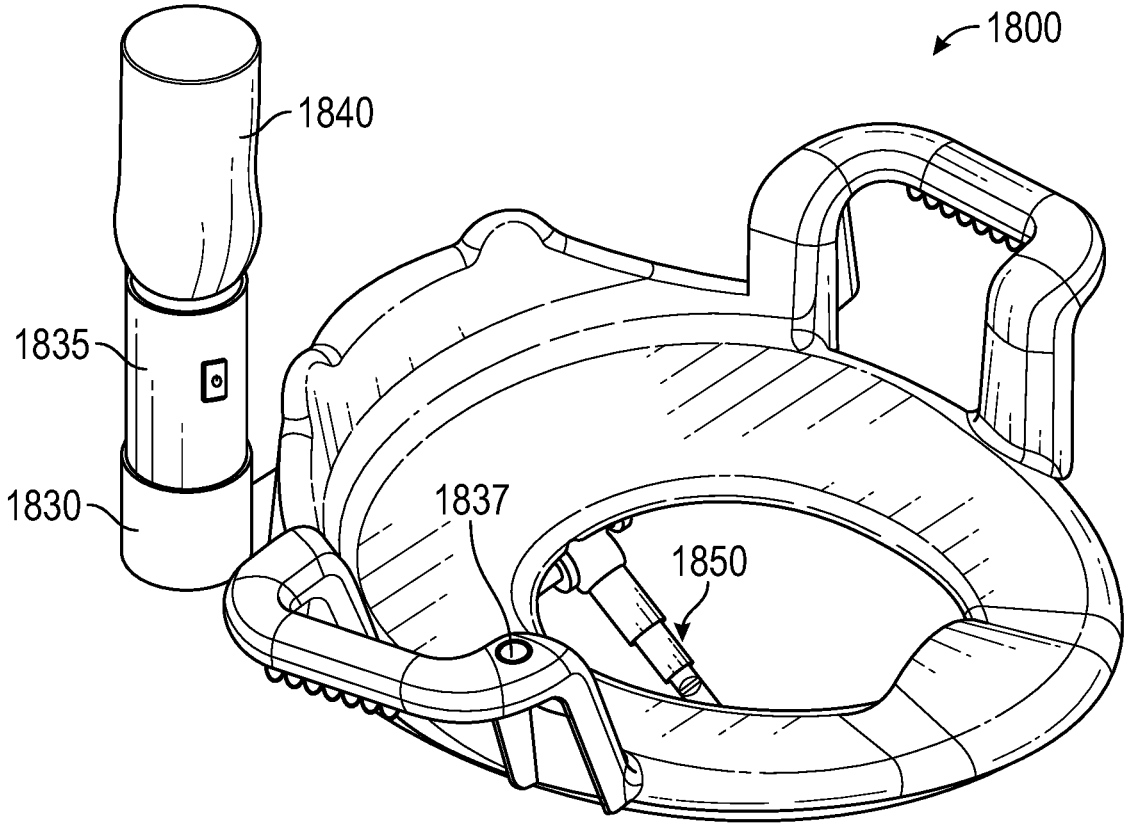
FIG. 18 illustrates a portable child seat bidet, according to an embodiment.

FIG. 18 illustrates a portable child seat bidet 1800, according to an embodiment. In the embodiments shown, the power button (switch) is located on the handle 1820, 1822, and wirelessly turns the power of the pump of the pump assembly 1835 on and off. The power button can be mounted on the pump assembly, and the power button can be connected via wires to a main circuit board of the pump assembly.

Figure 19:
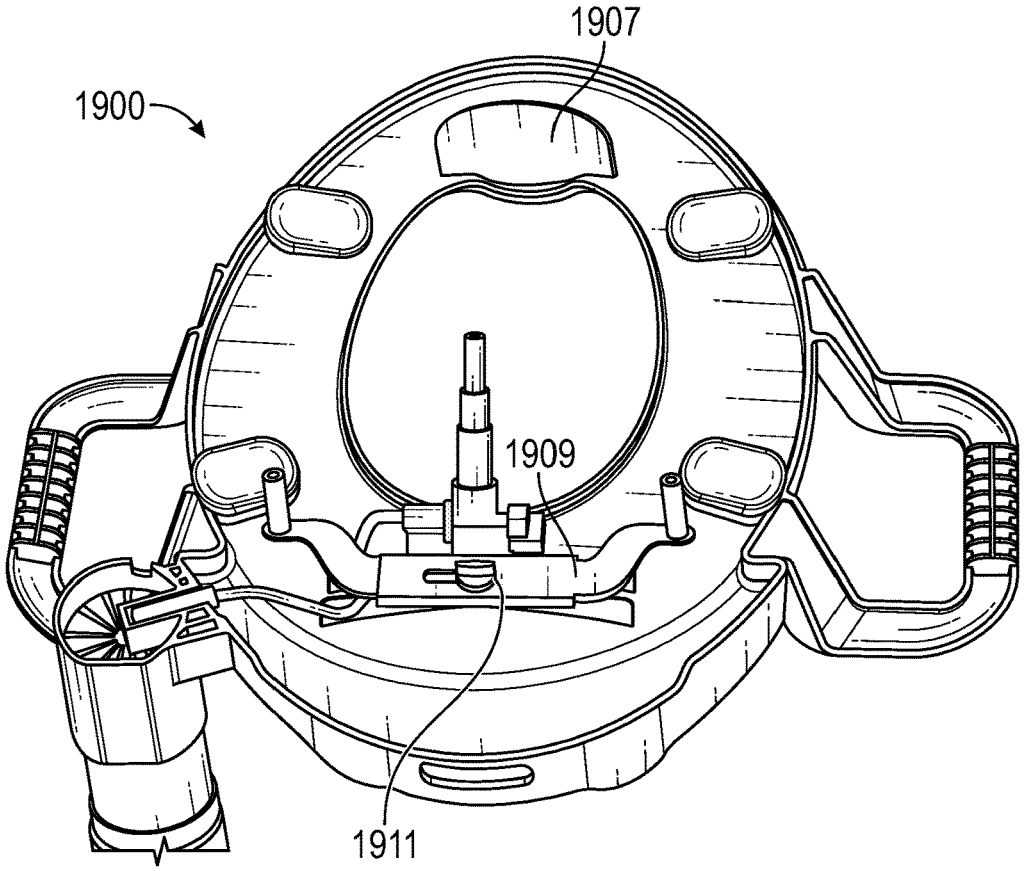
FIG. 19 illustrates the bottom side of a portable child seat bidet, according to an embodiment.

FIG. 19 illustrates the bottom side 1905 of a portable child seat bidet 1900, according to an embodiment. In the embodiment shown by FIG. 19, a front anti-slip bezel 1907, an adjustable spacer 1909, and a knob 1911 are included. The adjustable spacer 1909 moves left and right to adjust the position of the portable child seat bidet 1900 to sit on an adult toilet seat.

Figure 20:
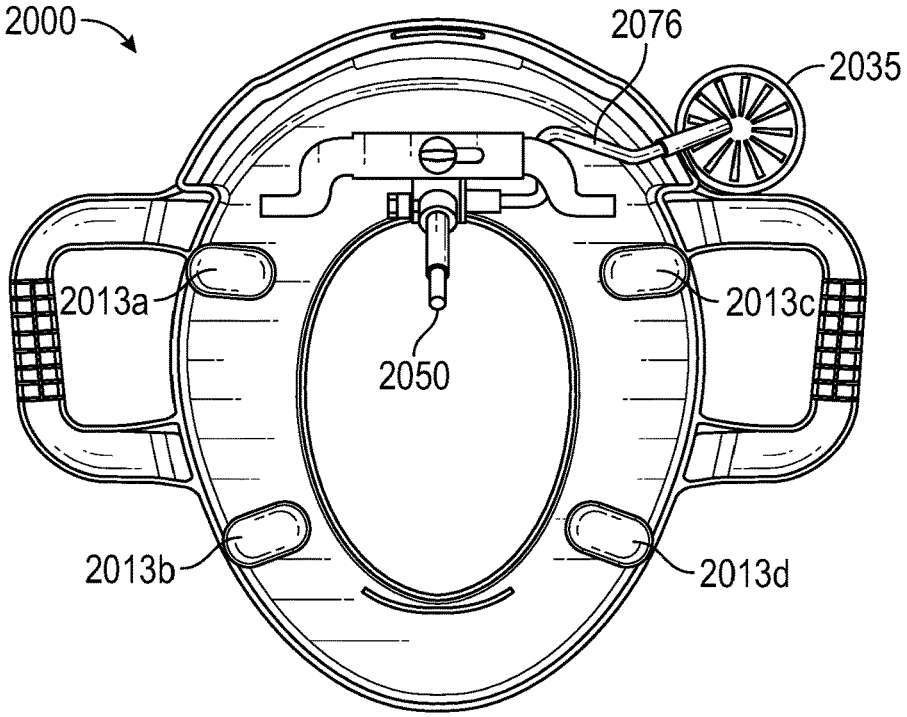
FIG. 20 illustrates the bottom side of a portable child seat bidet, according to an embodiment.

FIG. 20 illustrates the bottom side portion 2005 of a portable child seat bidet 2000, according to an embodiment. In the embodiment shown in FIG. 20, a PU hose or tube 2076 connects the pump assemble 2035 (or electric bidet body) to the nozzle 2050. Four non-slip mats 2013*a*, 2013*b*, 2013*c*, 2013*d* are also shown, spaced a proportional distance around the bottom side portion 2005 of the portable child seat bidet 2000 to facilitate stability. The child seat bidet can include non-slip mats mounted on an underside of the seat frame, and an anti-slip bezel mounted on a front portion of the underside of the seat frame. The non-slip mats and the anti-slip bezel can be configured to mount the seat frame to an adult toilet seat.

Figure 21:
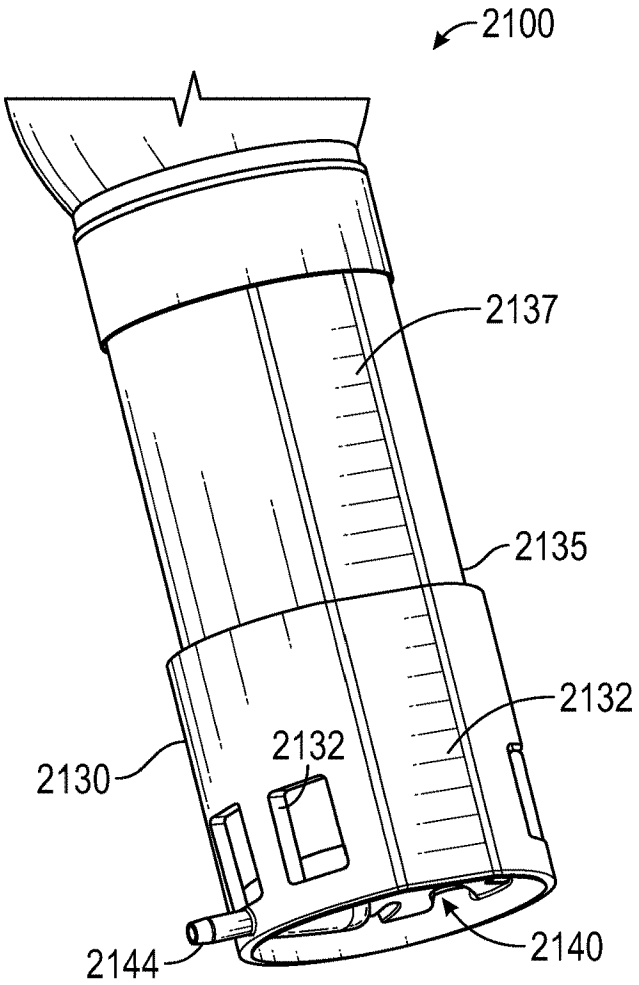
FIG. 21 illustrates a portion of a pump assembly, according to an embodiment.

FIG. 21 illustrates the pump assembly 2135 engaged with the port 2130 according to an embodiment. As illustrated in FIG. 21 the pump assembly 2135 is not perfectly round but includes a pump assembly flat portion 2137 that allows alignment of the pump assembly 2135 in the port 2130. The port 2130 includes a corresponding port flat portion 2132 that engaged with the pump assembly flat portion 2137 allowing for alignment of the liquid outtake 2144 and port aperture 2140. As illustrated, the pump assembly 2135 easily engages with the port 2130 via the two flat portions (2137 and 2132) with a small gap between the pump assembly 2135 and the port 2130. In some embodiments, the two flat portions (2137 and 2132) assist with guidance and anchoring of the pump assembly 2135 and the port 2130.

Figure 22:
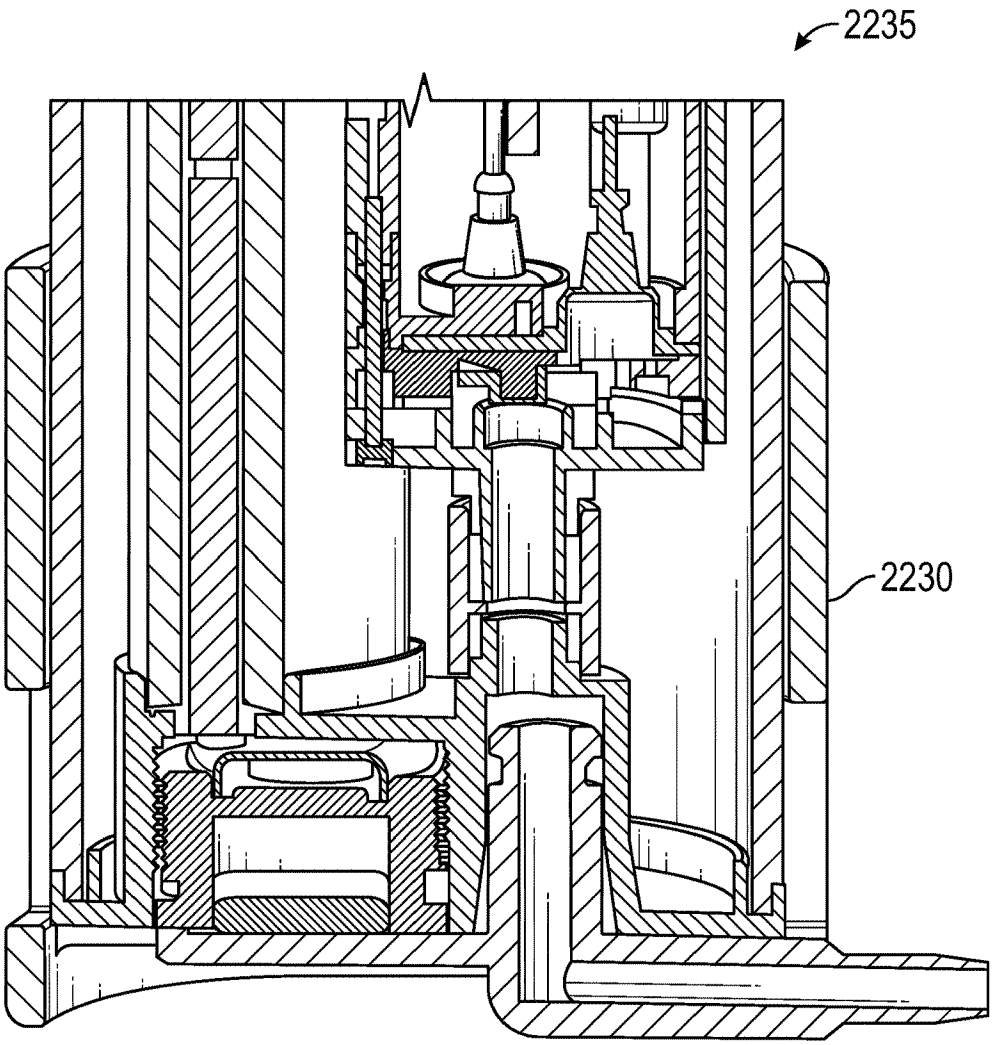
FIG. 22 illustrates a cross-section of a portion of a pump assembly, according to an embodiment.
Figure 23:
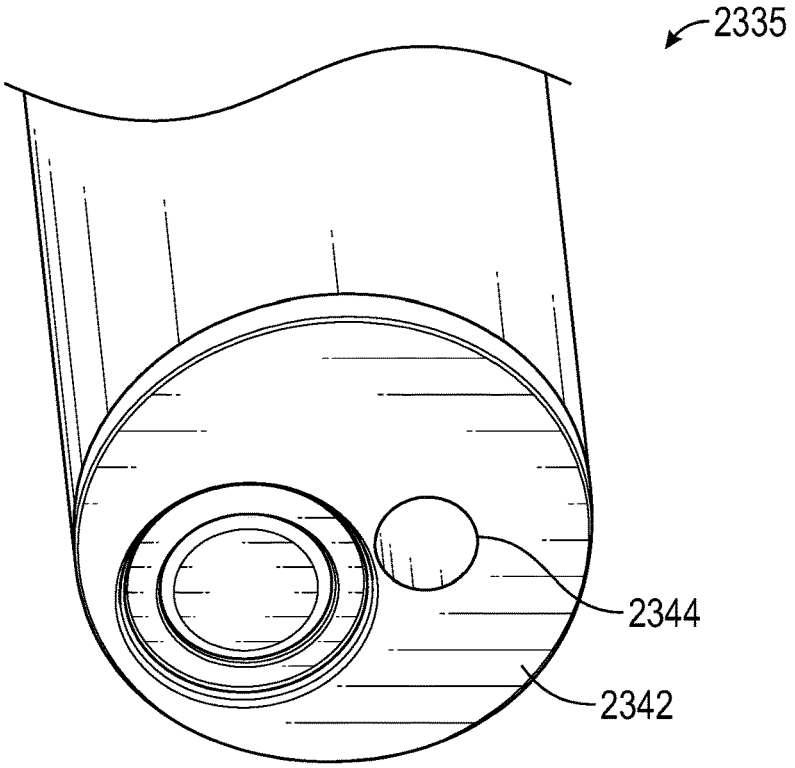
FIG. 23 illustrates an end of a pump assembly, according to an embodiment.

FIG. 22 illustrates a cross-section of a portion of a pump assembly 2235, according to an embodiment. As shown, a battery powered pump may be used to provide water to the bidet nozzle 2250. FIG. 22 further illustrates the gap between pump assembly 2235 and the port 2230. FIG. 23 illustrates a first end of the pump assembly 2335, according to an embodiment. The first end of the pump assembly 2335 includes a pump assembly flat portion 2337 and a liquid outtake aperture 2344. The liquid outtake aperture 2344 is configured to engage with a port liquid intake (not shown). In the embodiment illustrated in FIG. 23, the liquid outtake aperture 2344 is off-center of the first end of the pump assembly 2335, which will require the first end of the pump assembly 2335 to engage with the port 2330 (not shown) in a specific configuration determined by the location and engagement of the pump assembly flat portion 2137 and port flat portion (not shown). The pump assembly liquid outtake can be located in a pump assembly aperture, and a port bottom portion can be configured with a port first aperture configured to anchor the port to the seat frame and a port water intake, wherein the port water intake is configured to engage the pump assembly aperture, anchor the pump assembly, and receive water from the pump assembly liquid outtake.

Figure 24:
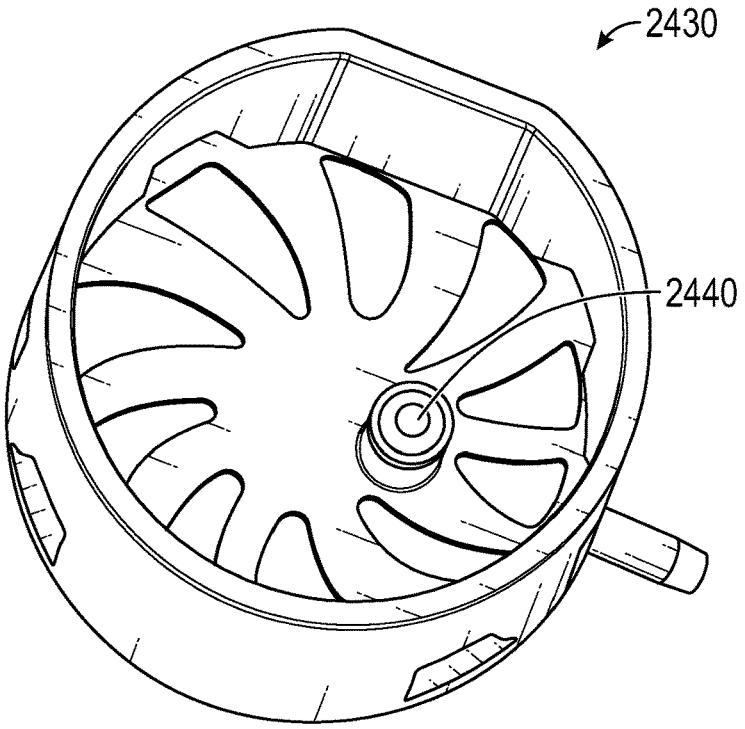
FIG. 24 illustrates a port, according to an embodiment.

FIG. 24 illustrates a port 2430, according to an embodiment. The port 2430 includes a port liquid intake 2440 (convex column) which is configured to engage with the liquid outtake aperture 2344 (see FIG. 23) of the pump assembly and allow for fluid flow therethrough. The port 2430 further includes a port wall flat portion 2432 configured to engage the pump assembly flat portion 2337 (see FIG. 23) which allows the port liquid intake 2440 to align with the liquid outtake aperture 2344.

Embodiments of the pump assembly has a generally cylindrical geometry with a flattened vertical portion. The port has a generally cylindrical geometry with a flattened vertical portion. The flattened vertical portions are configured to engage and anchor the pump assembly in the port.

Figure 25:
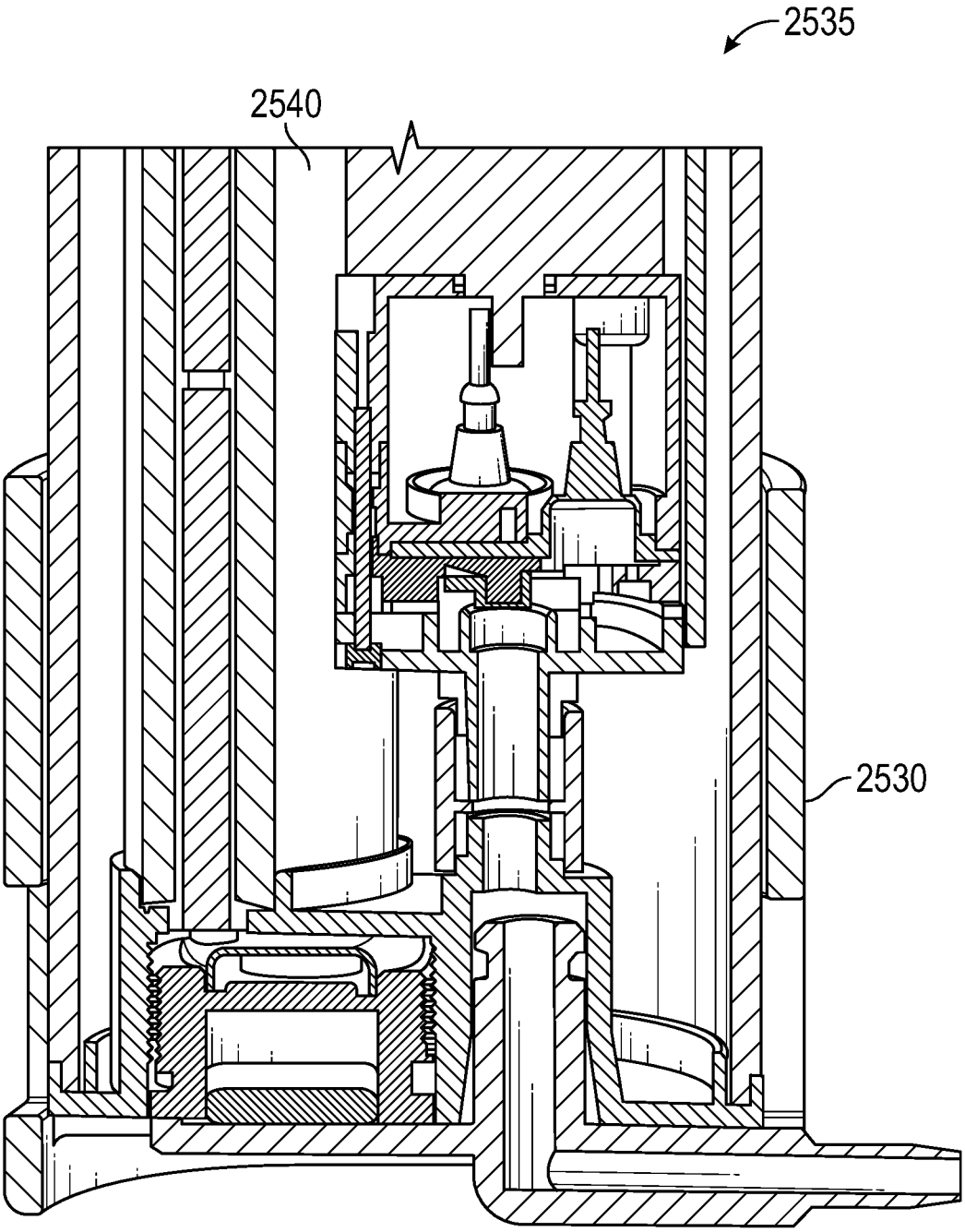
FIG. 25 illustrates a cross-section of a portion of a pump assembly, according to an embodiment.

FIG. 25 illustrates a cross-section of a portion of a pump assembly 2535 engaged with the port 2530, according to an embodiment. As shown, liquid outtake aperture 2544 includes a bevel to allow for easier engagement with the port liquid intake 2440 to facilitate mating of parts, such as by facilitating alignment during joining.

Figure 26:
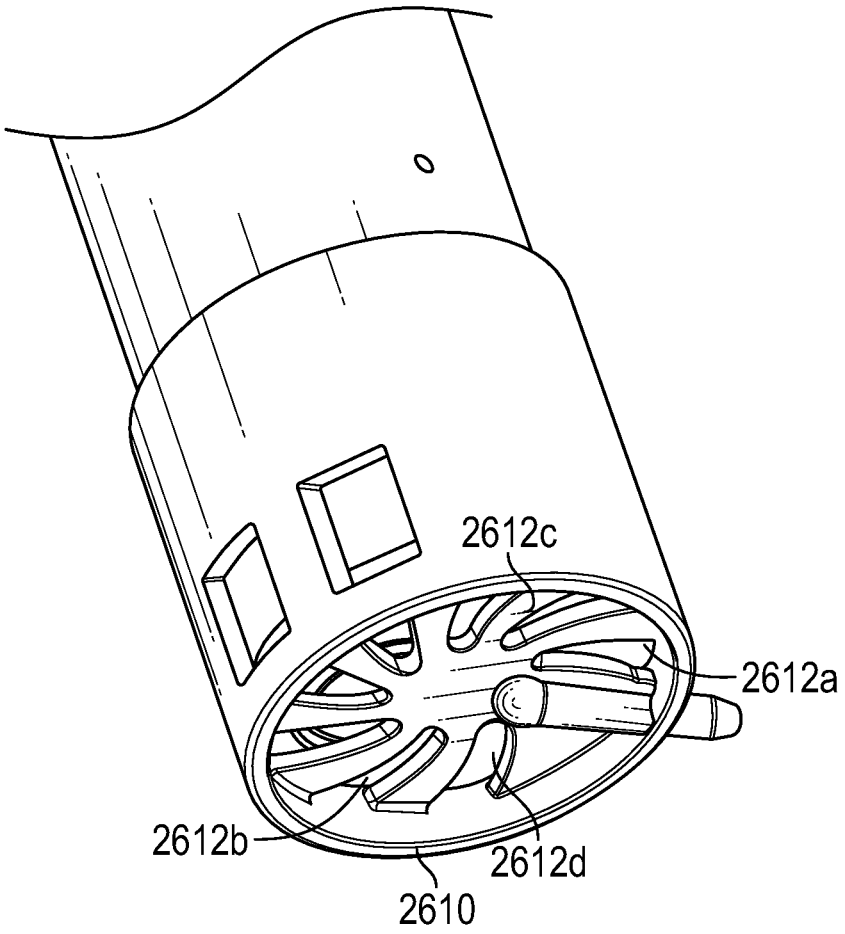
FIG. 26 illustrates an end portion of a portable bidet and a port, according to an embodiment.

FIG. 26 illustrates a port 2630, according to an embodiment. As shown, the port wall 2620 and port base 2610 include vents or apertures 2612*a*, 2612*b*, 2612*c*, 2612*d* to avoid accumulation of water and easy flow of air. The port wall 2620 and port base 2610 apertures 2612*a*, 2612*b*, 2612*c*, 2612*d* can facilitate the desirable feature of allowing air replenishment (refilling the vacuum created) so that the pump assembly 2635 can be easily removed from the port 2630 whether the vessel and/or pump assembly are full or empty of water. This avoids the buildup of negative pressure complicating removal of the pump assembly 2635 from the port 2630. The port cylindrical wall portion include apertures configured to increase water flow and air flow. The port bottom portion include apertures configured to increase water flow and air flow.

Embodiments of the child bidet seat can include A portable child seat bidet including a seat frame including a first handle, a second handle, a seat back, a central aperture; and an adjustable spacer. The pump assembly can include a pump, a battery assembly, a pump assembly threaded end, a liquid intake, a liquid outtake, an air intake, and an air outtake. The pump assembly can have a cylindrical geometry with a flattened portion along a vertical length of an exterior wall of the pump assembly. The vessel can be configured to hold liquid and include a threaded end configured to engage the pump assembly threaded end. The port can include a port bottom portion, wherein the port bottom portion includes a port first aperture, wherein the port first aperture is configured to anchor the port to the seat frame. A port second aperture, wherein the port second aperture is configured to engage the pump assembly liquid outtake and receive water from the pump assembly liquid outtake. A port cylindrical wall portion wherein the port has a cylindrical geometry with a flattened portion along a vertical length of the port cylindrical wall portion and wherein the flattened portion of the port cylindrical wall portion is configured to engage with the flattened portion of the pump assembly. The child seat bidet can further include tubing, and a bidet assembly including a bidet assembly housing, and a nozzle. The tubing can be configured to connect the port second aperture to the nozzle allowing water to flow from the vessel through the pump assembly into the port through the tube and out of the nozzle.

Figure 27:
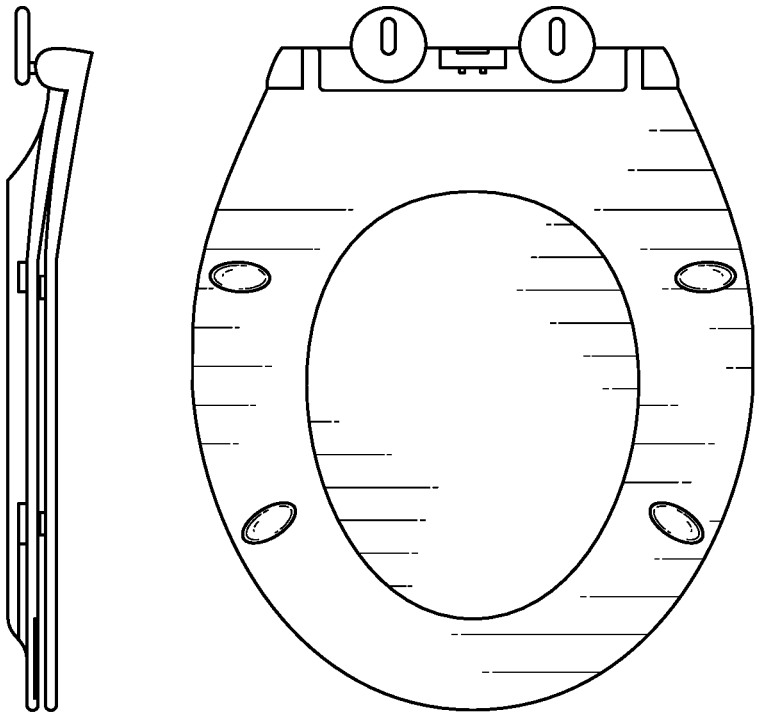
FIG. 27 illustrates a first adult toilet seat.

FIG. 27 illustrates a first adult toilet seat schematic. The schematic shown is a common design for an adult toilet seat for which the child seat bidets discloses herein may be suitably used.

Figure 28:
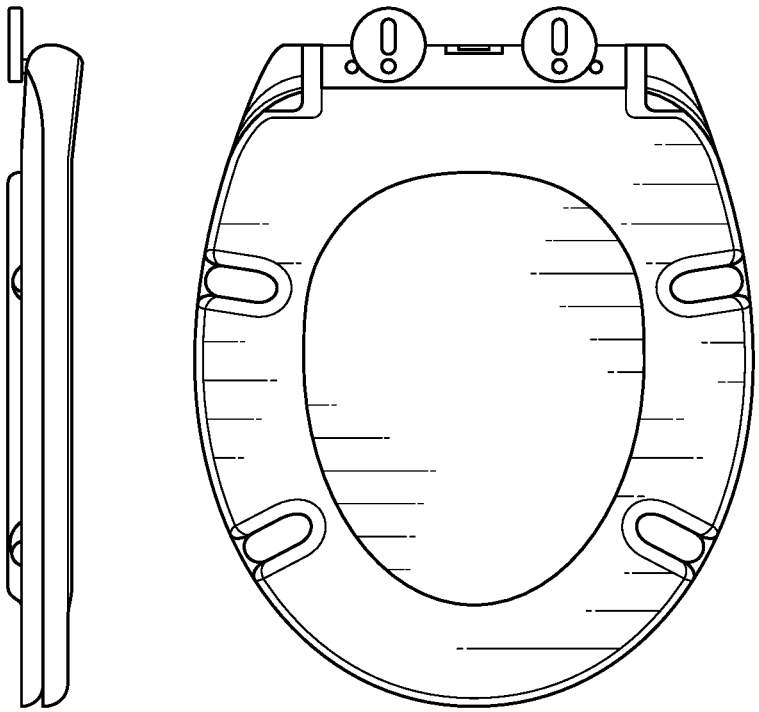
FIG. 28 illustrates a second adult toilet seat.

FIG. 28 illustrates a second adult toilet seat schematic. The schematic shown is a common design for an adult toilet seat for which the child seat bidets discloses herein may be suitably used.

Figure 29:
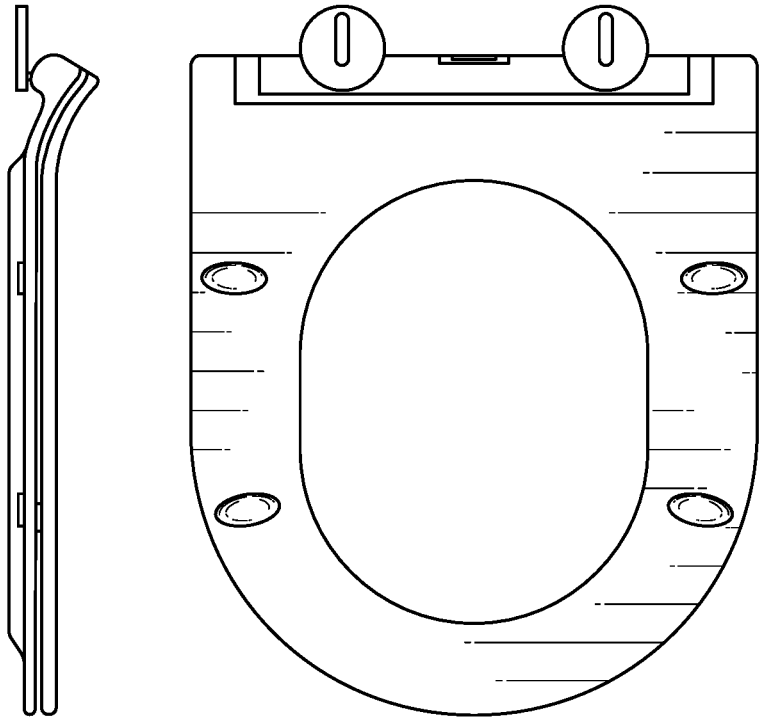
FIG. 29 illustrates a third adult toilet seat.

FIG. 29 illustrates a third adult toilet seat schematic. The schematic shown is a common design for an adult toilet seat for which the child seat bidets discloses herein may be suitably used.

Figure 30:
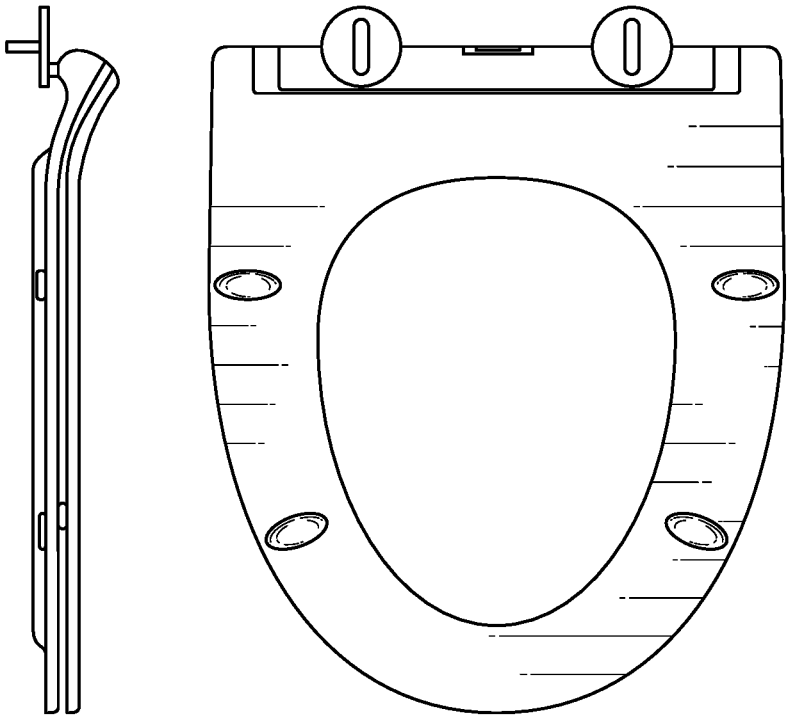
FIG. 30 illustrates a fourth adult toilet seat.

FIG. 30 illustrates a fourth adult toilet seat schematic. The schematic shown is a common design for an adult toilet seat for which the child seat bidets discloses herein may be suitably used.

Figure 31:
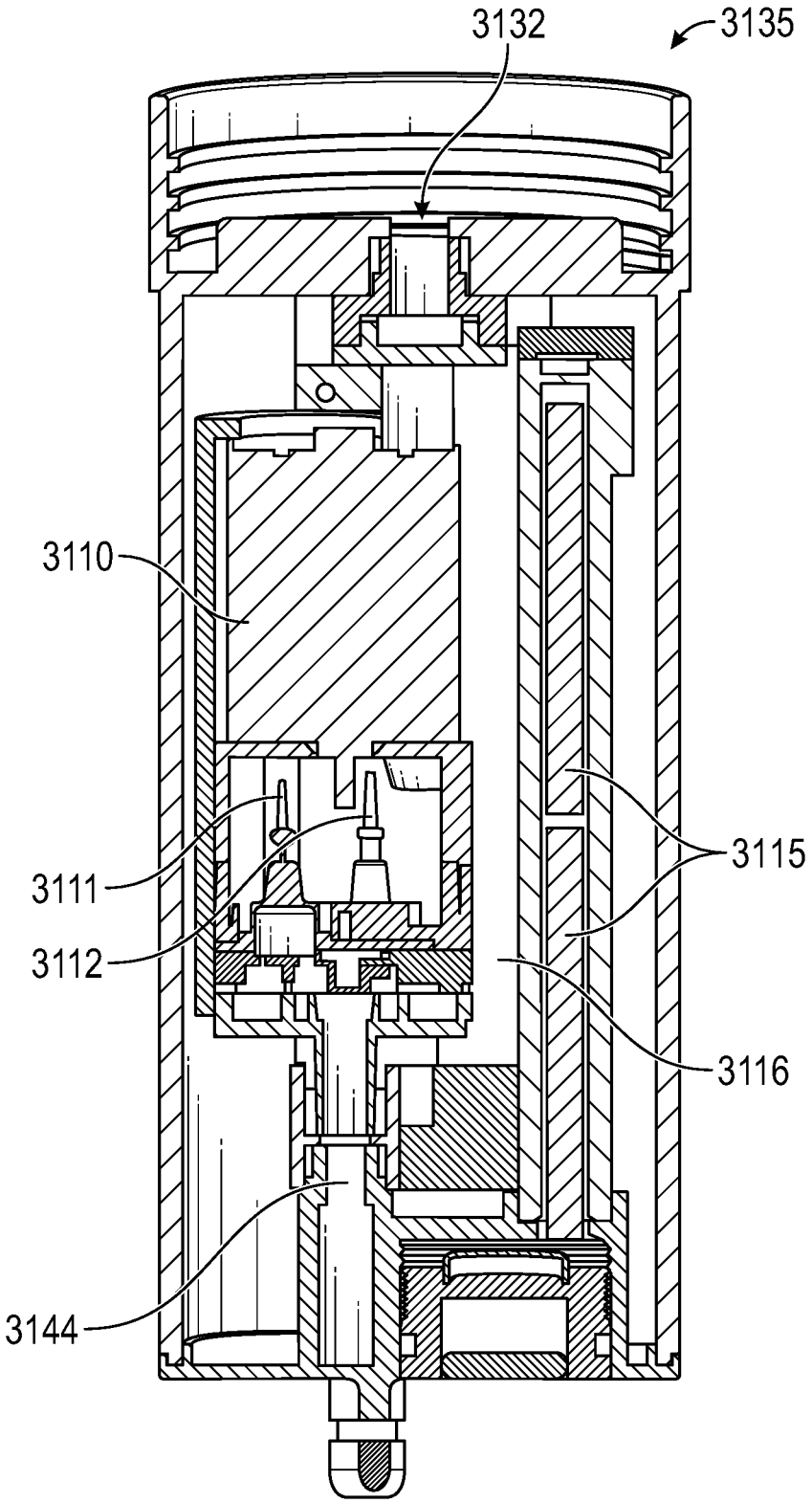
FIG. 31 illustrates a cross-section of a bidet pump assembly, according to an embodiment.

FIG. 31 illustrates a cross-section of a bidet pump assembly 3135, according to an embodiment. As shown, the pump assembly 3135 includes a water inlet port 3132, a water outlet port 3144, a pump 3110, a water flow pipe 3116, and a battery receptacle 3115 in electrical communication with the pump 3110. As also shown, the pump 3110 of the pump assembly 3135 includes a water inlet port 3111 and a water outlet port 3112.

Figure 32:
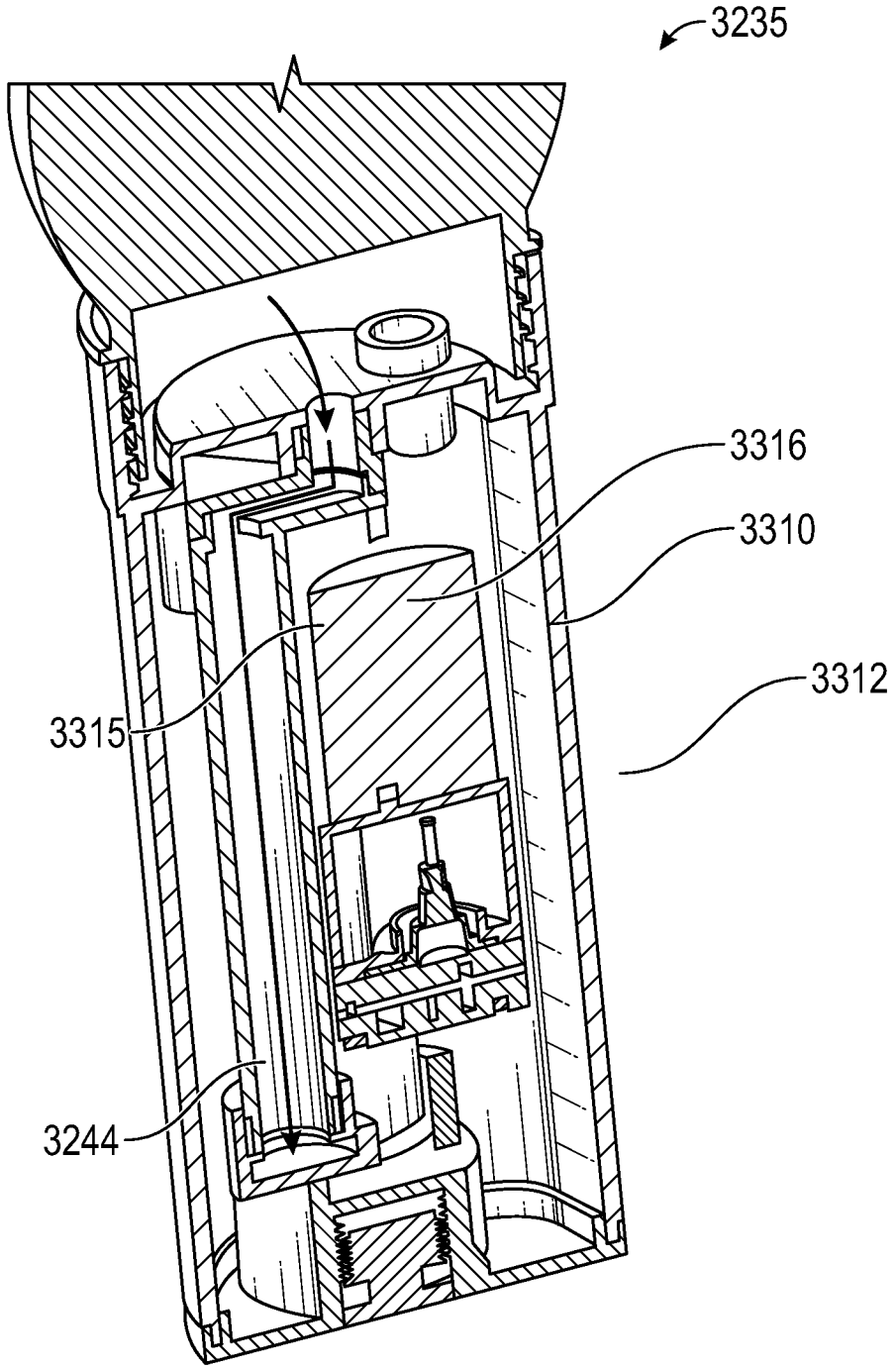
FIG. 32 illustrates a cross-section of a bidet pump assembly, showing a first portion of a liquid flow, according to an embodiment.

FIG. 32 illustrates a cross-section of a bidet pump assembly 3235, showing a first portion of a liquid flow, according to an embodiment. As shown, the first portion of the water flow may include water flowing into a water inlet port 3232 pump assembly 3235 and into the water flow pipe 3216.

Figure 33:
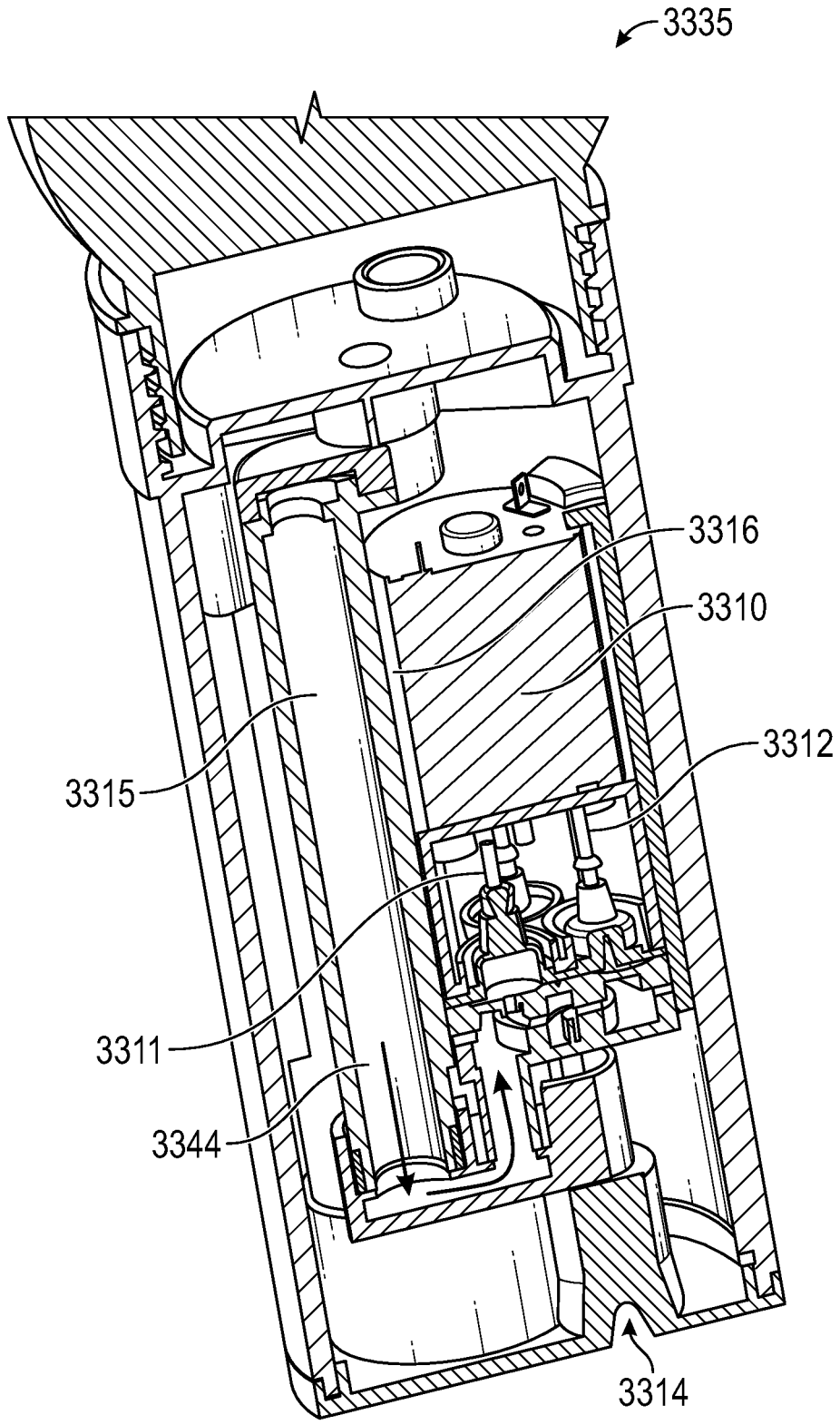
FIG. 33 illustrates a cross-section of a bidet pump assembly, showing a second portion of a liquid flow, according to an embodiment.

FIG. 33 illustrates a cross-section of a bidet pump assembly 3335, showing a second portion of a liquid flow, according to an embodiment. As shown, the second portion of the flow may include water flowing from the water flow pipe 3316 to the water inlet port 3311 of the pump of the pump assembly 3335. The pump 3310 may then cause the water to be pumped out from the outlet port 3312 of the pump and out of the pump assembly liquid outtake 3344.

Figure 34:
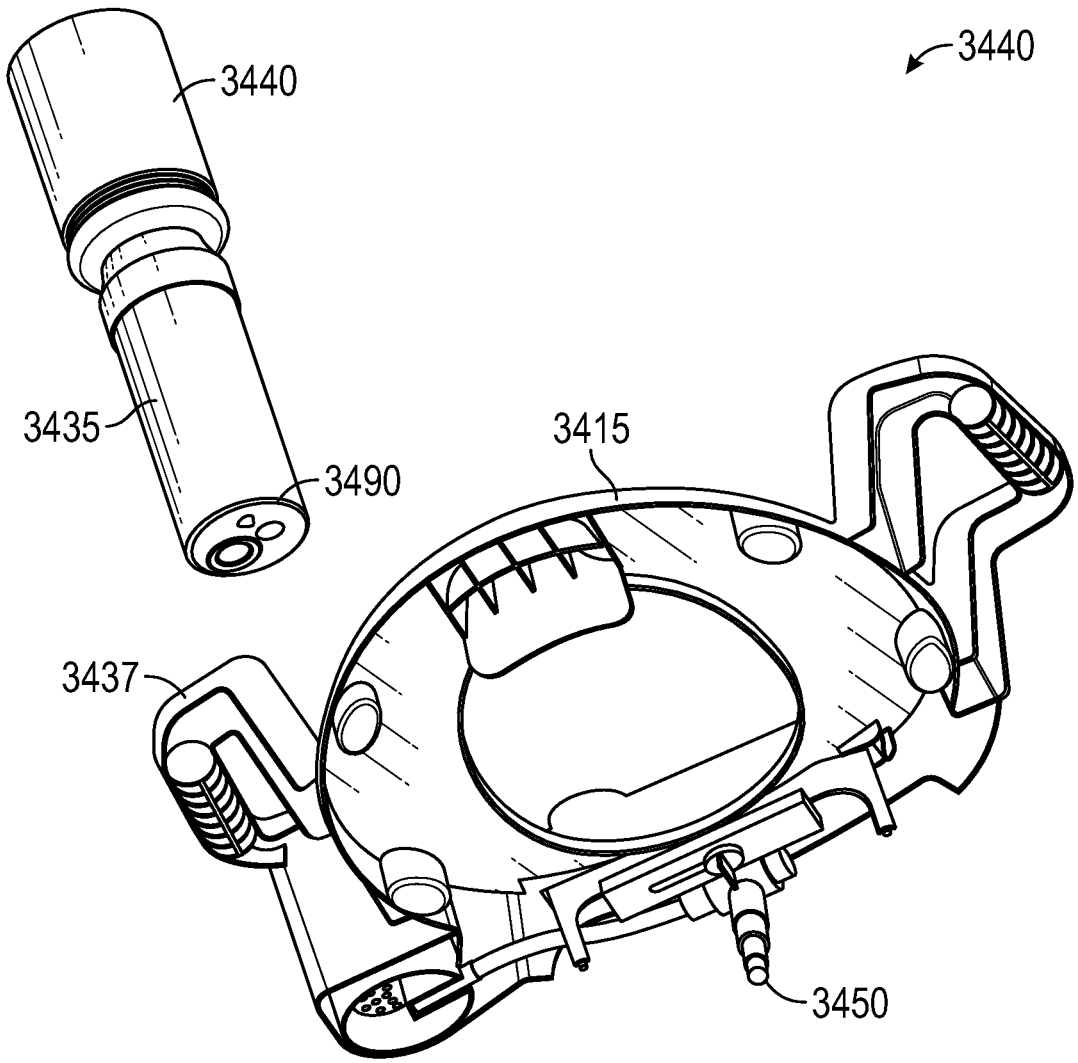
FIG. 34 illustrates an exploded view of the portable child seat bidet, according to an embodiment.

FIG. 34 illustrates an exploded view of the portable child seat bidet 3400, according to an embodiment. FIG. 34 illustrates the vessel 3440, the pump assembly 3435, the bidet seat 3415, the nozzle 3450, power button 3437 (or power switch), a trigger switch 3490, according to an embodiment. The power button can be mounted on a handle of the seat frame, and the power button can be wirelessly connected to a main circuit board of the pump assembly.

Figure 35:
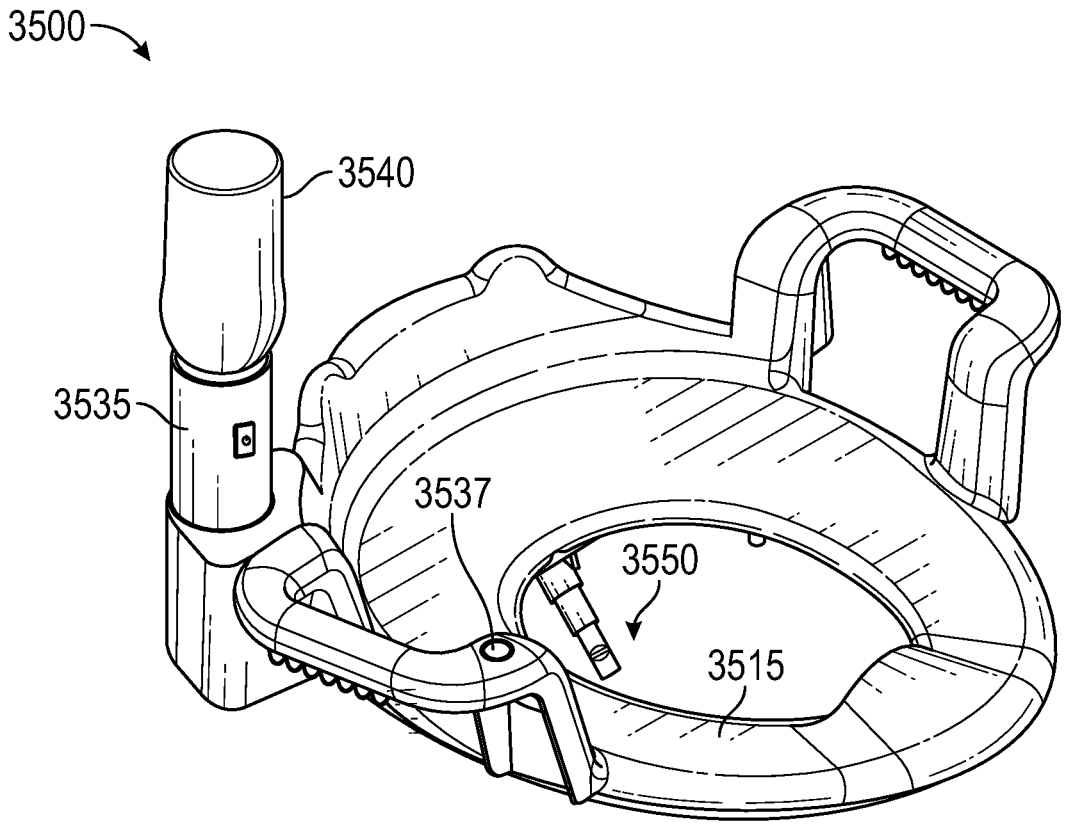
FIG. 35 illustrates an assembled view of the portable child seat bidet, according to an embodiment.

FIG. 35 illustrates an assembled view of the portable child seat bidet 3500, according to an embodiment. FIG. 35 illustrates the vessel 3540, the pump assembly 3535, the bidet seat 3515, the nozzle 3550, and a power (on/off) switch 3537, according to an embodiment.

Figure 36C:
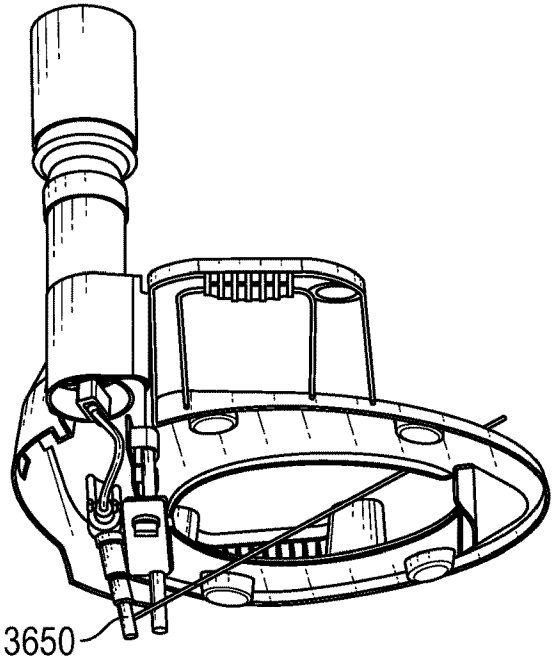
FIG. 36C illustrates a first setting for the nozzle that directs water at an angle at approximately 90°, according to an embodiment.
Figure 36B:
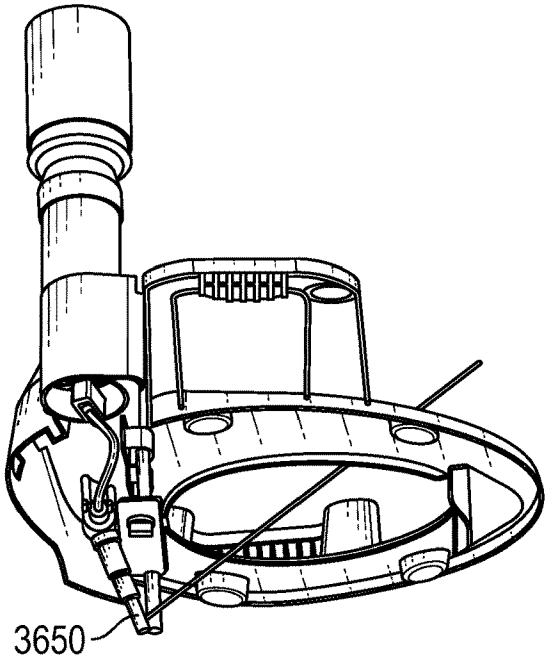
FIG. 36B illustrates a first setting for the nozzle that directs water at an angle at approximately 45°, according to an embodiment.
Figure 36A:
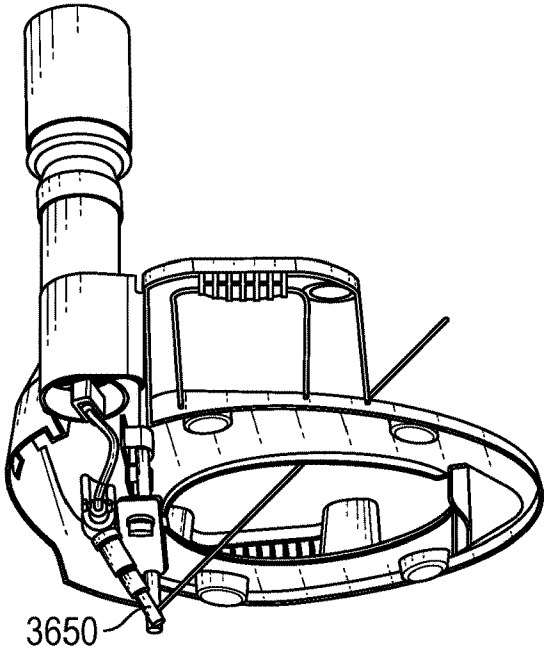
FIG. 36A illustrates a first setting for the nozzle that directs water at an angle at approximately 30°, according to an embodiment.

FIG. 36 illustrates three settings for the nozzle of the portable child seat bidet 3600, according to an embodiment. FIG. 36*a* illustrates a first setting for the nozzle 3650 that directs water at an angle at approximately 30°. FIG. 36*b* illustrates a first setting for the nozzle 3650 that directs water at an angle at approximately 45°. FIG. 36*c* illustrates a first setting for the nozzle 3650 that directs water at an angle at approximately 90°. The bidet housing assembly can be configured to provide a range of angles for water output from the nozzle, including range of angles varying from 90° to 30° C.

Figure 37:
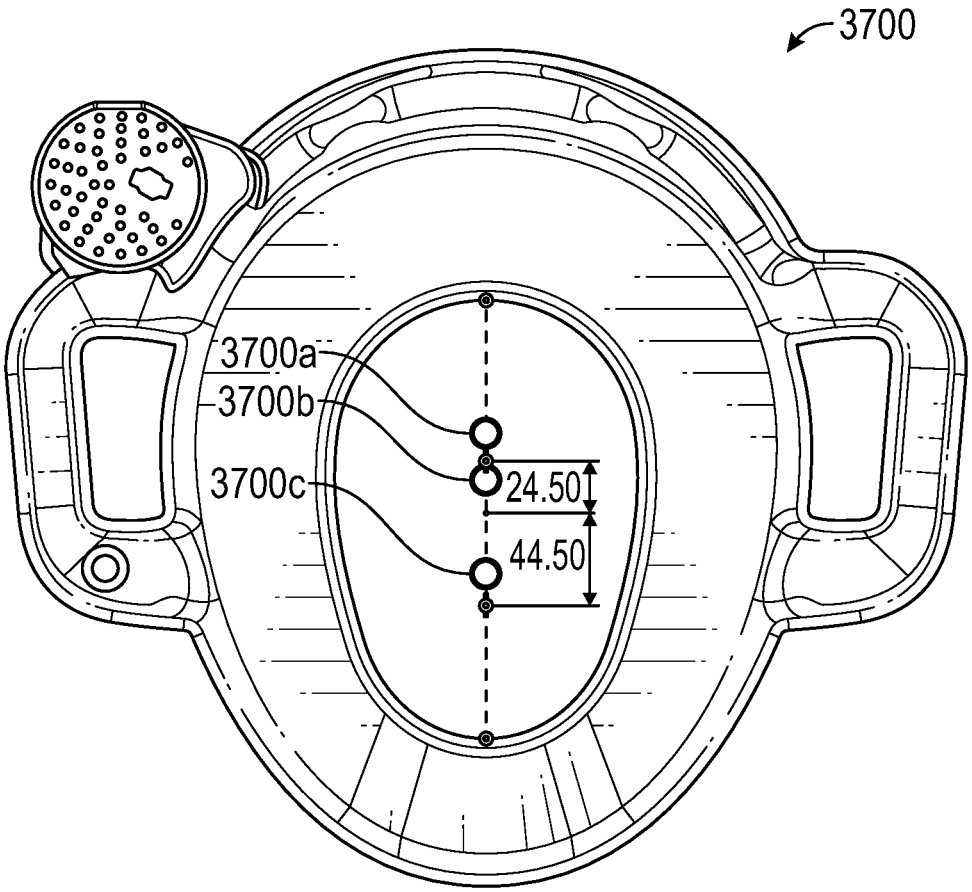
FIG. 37 illustrates three settings for the nozzle of the portable child seat bidet, according to an embodiment.

FIG. 37 illustrates three settings for the nozzle of the portable child seat bidet 3700, according to an embodiment. Position 3700*a* illustrates a first location for water spray from the nozzle 3750 that directs water at an angle at approximately 30°, as per FIG. 36*a*. Position 3700*b* illustrates a first location for water spray from the nozzle 3750 that directs water at an angle at approximately 45°, as per FIG. 36*b*. Position 3700*c* illustrates a first location for water spray from the nozzle 3750 that directs water at an angle at approximately 90°, as per FIG. 36*c*.

Figure 38:
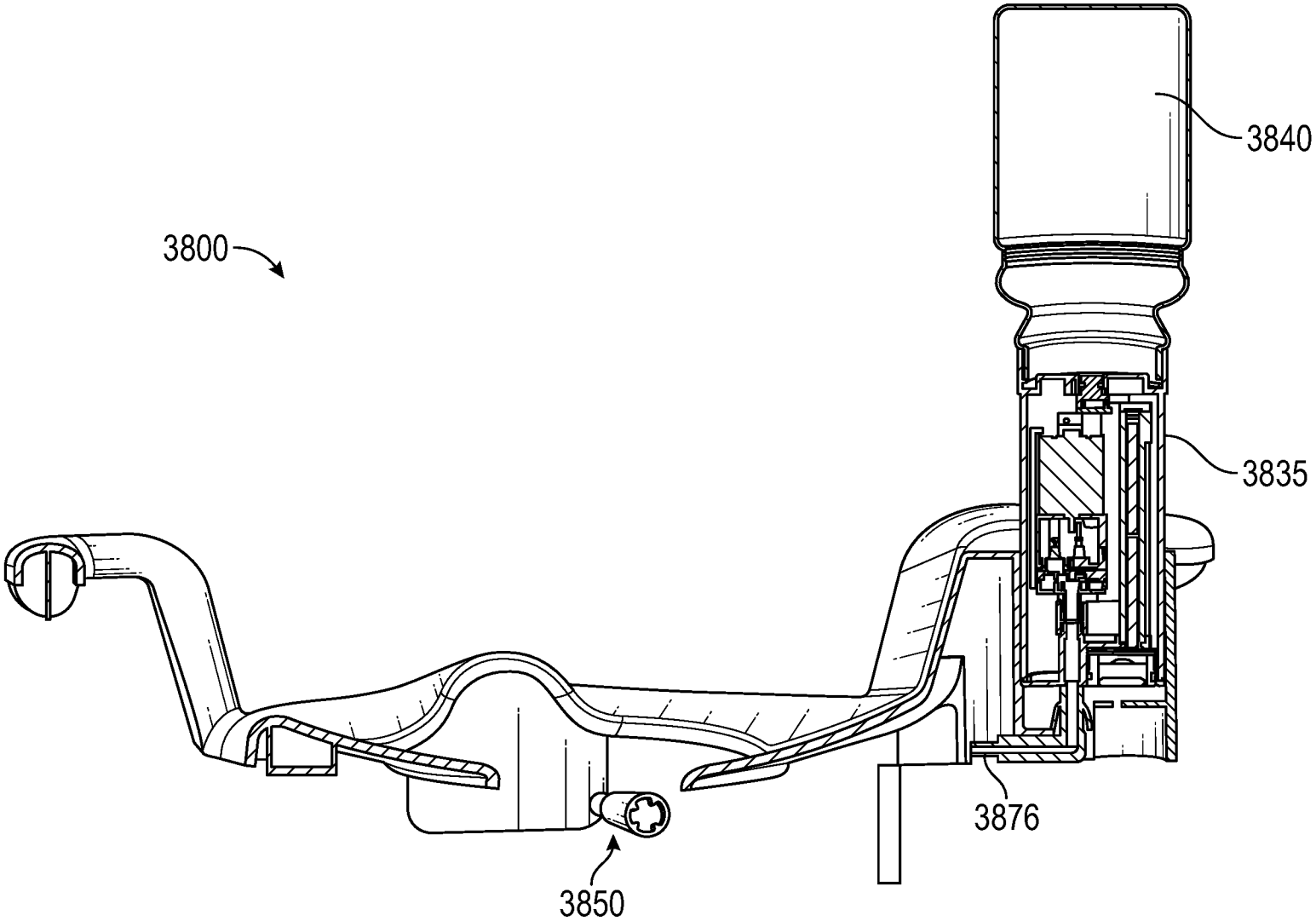
FIG. 38 illustrates a cross section of the portable child seat bidet, according to an embodiment.

FIG. 38 illustrates a cross section of the portable child seat bidet 3800, according to an embodiment. FIG. 38 illustrates the flow of water from the vessel 3840 into the pump assembly 3835, into the port 3830, into a tube 3876, and to the nozzle 3850.

Figure 39A:
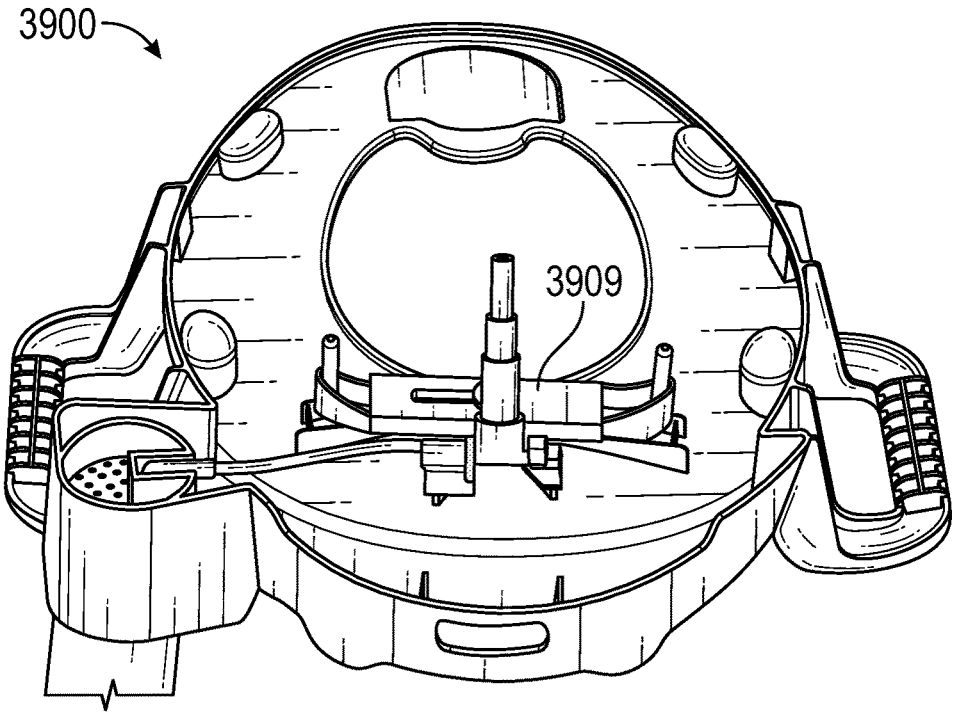
FIG. 39A illustrates the adjustable spacer in a short configuration, according to an embodiment.
Figure 39B:
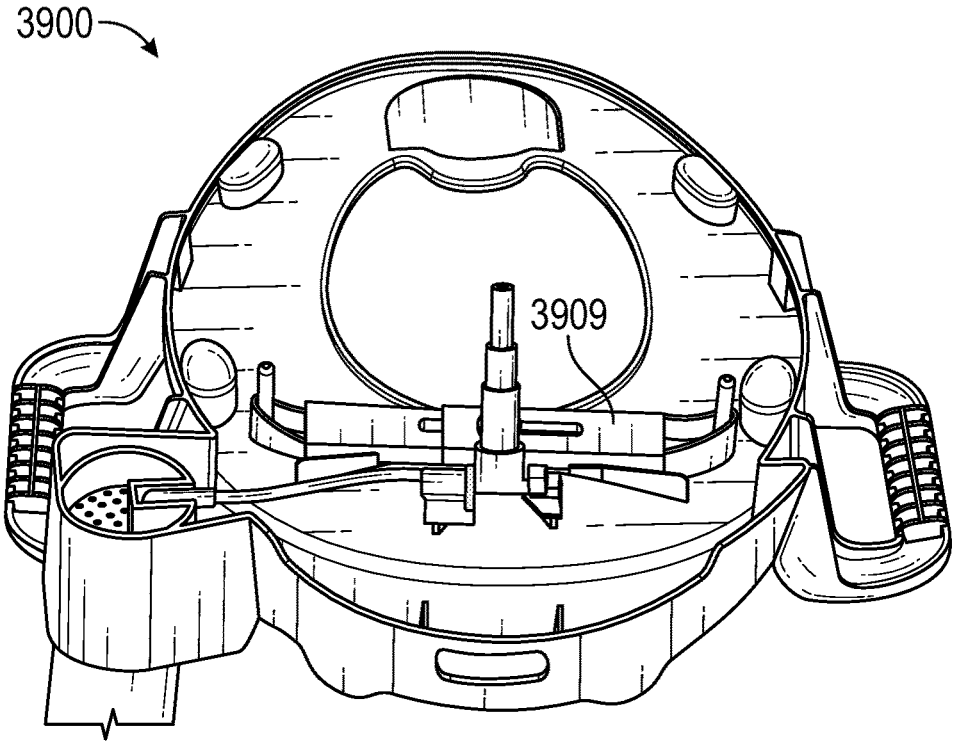
FIG. 39B illustrates the adjustable spacer in a long configuration, according to an embodiment.
Figure 39C:
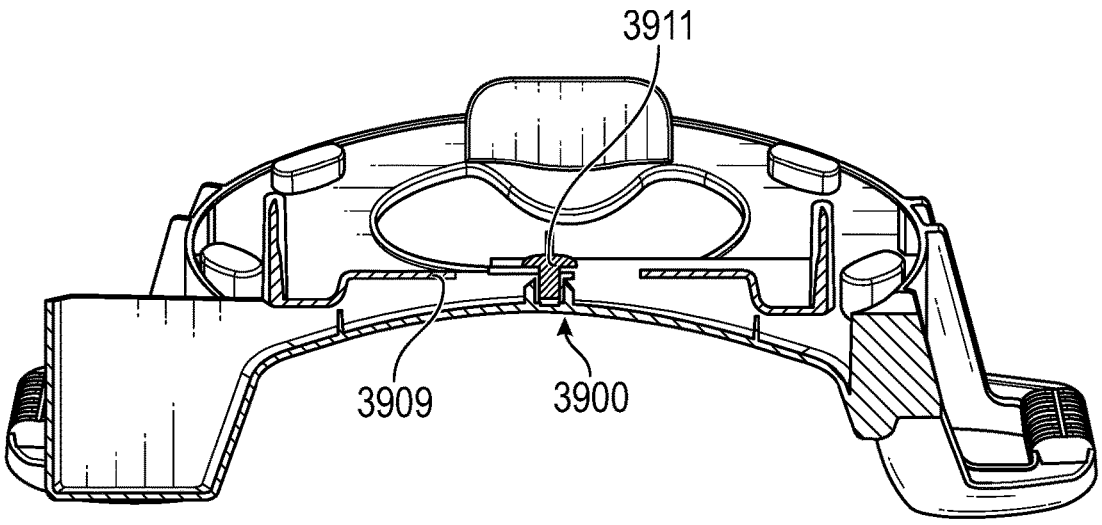
FIG. 39C illustrates a knob that can be turned to adjust the length of the adjustable spacer to accommodate different size adult toilet seats, according to an embodiment.

FIG. 39 illustrates an adjustable spacer 3909 for the portable child seat bidet 3900, according to an embodiment. FIG. 39*a* illustrates the adjustable spacer 3909 in a short configuration. FIG. 39*b* illustrates the adjustable spacer 3909 in a long configuration. A knob 3911 shown in FIG. 39*c* can be turned to adjust the length of the adjustable spacer to accommodate different size adult toilet seats. The adjustable spacer can include a knob configured to adjust the length of the adjustable space, and the adjustable spacer can be configured to securely mount the seat frame to an adult toilet seat.

Figure 40:
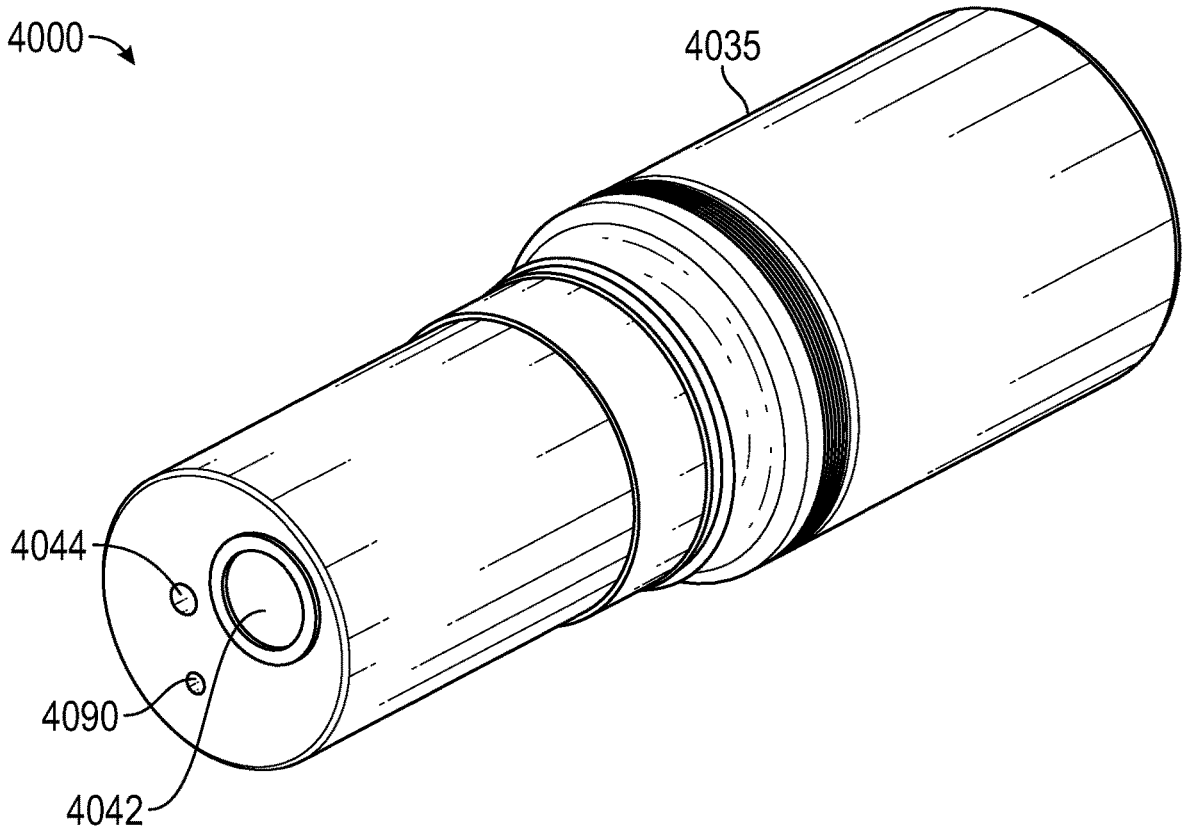
FIG. 40 illustrates a pump assembly for the portable child seat bidet, according to an embodiment.

FIG. 40 illustrates a pump assembly for the portable child seat bidet 4000, according to an embodiment. The pump assembly 4035 illustrated in FIG. 40 includes a trigger switch 4090 that engages when the pump assembly 4035 is inserted into the port (not shown). The trigger switch 4090 activates and de-activates the pump assembly 4035 to ensure it does not turn on when not in contact with the port. FIG. 40 further illustrates the embodiment with a pump assembly aperture wherein the pump assembly water outtake is located.

Figure 41:
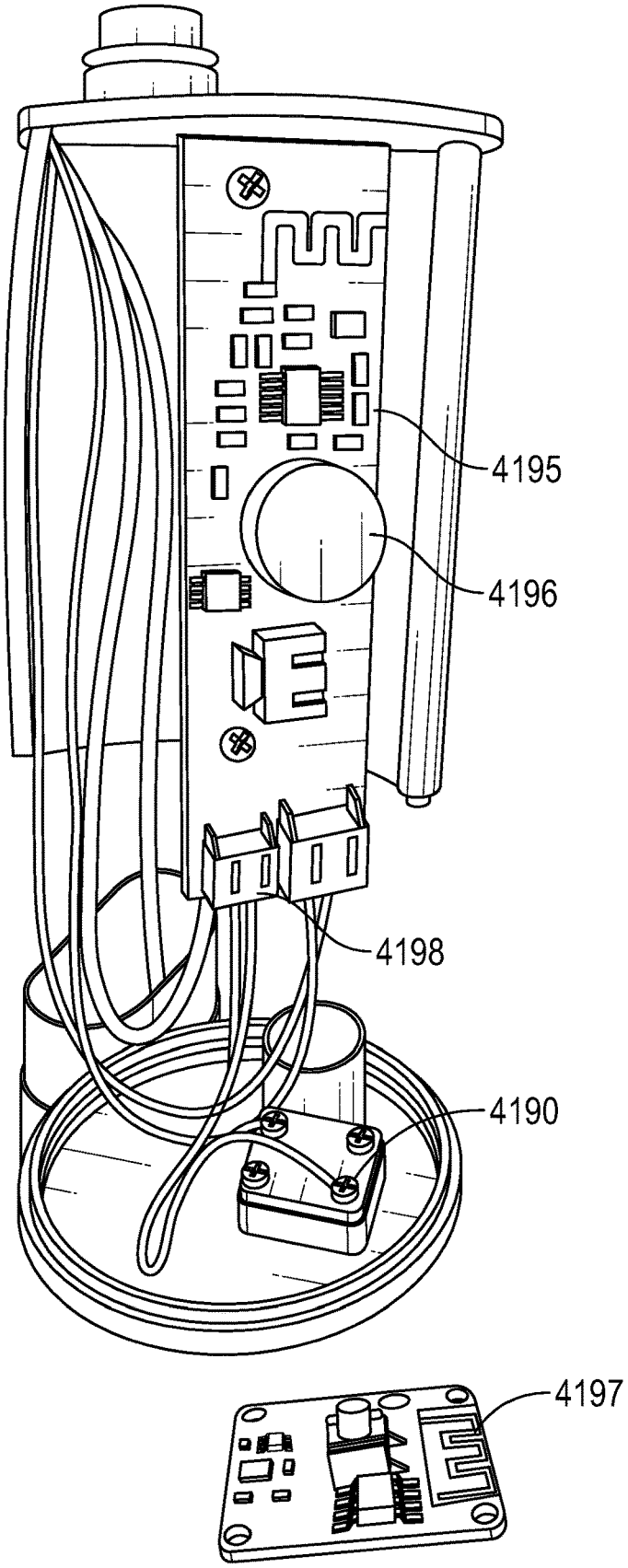
FIG. 41 illustrates a circuit board for a portable child seat bidet, according to an embodiment.

FIG. 41 illustrates a circuit board 4195 of the portable child seat bidet, according to an embodiment. In an embodiment, a main circuit board 4195 of the child bidet seat can be powered by four AAA batteries 4198. The main circuit board 4195 can control the operation of the water pump. The main circuit board 4195 can be connected to trigger switch 4190, which can control the main circuit board 4195 or receive wireless signals. When the trigger switch 4190 is triggered and the main circuit board 4195 can enter a wake-up state. The trigger switch 4190 being activated will engage a buzzer 4196 which can sound once for approximately 0.3 to 0.5 s. The buzzer is configured to notify a user that the pump assembly is activated. Approximately 30 minutes after the trigger switch 4190 is triggered, the main circuit board 4195 will be in a wake-up state, and a wireless switch 4197 can control the operation of the main circuit board 4195. In other embodiments and at other times, the main circuit board 4195 can be in standby mode to reduce power consumption. The main circuit board 4195 can provides two types of water pump output strengths. A first output strength is at 80% power state (weak range setting) and the second is at 100% power state (strong range setting). When the main circuit board 4195 is in the wake-up state, a user can press the wireless switch 4197 once to release water at the weak range of the water pump. The user can press the wireless switch 4197 a second time to release water at the strong range, and then press the wireless switch 4197 a third time to turn off the water. The water pump will automatically shut down after a single working time of approximately 40 seconds to avoid users forgetting to turn it off and consuming electricity. If the wireless switch 4197 is not turned off, the water pump will complete 40 seconds of operation, even if the main circuit board exceeds the wake-up time. The control distance of the wireless switch is approximately 1 meter (assuming barrier free penetration). The main circuit board 4195 can sound the buzzer 4196 three times (including one sound upon awakening), one sound per second, and each sound can be approximately 0.3-0.5 s. The main circuit board 4195 can be insulated and protected. A wireless remote control 4198 can be matched with the main circuit board 4195 of the child bidet seat.

Embodiments of the pump assembly includes a trigger switch, wherein the trigger switch is configured to engage with the port bottom wall, and when the trigger switch is engaged the pump assembly is activated.

Embodiments of the remote control can be configured to connect wirelessly to a main circuit board of the pump assembly, and the pump assembly can be controlled wirelessly via the remote control.

Figure 42:
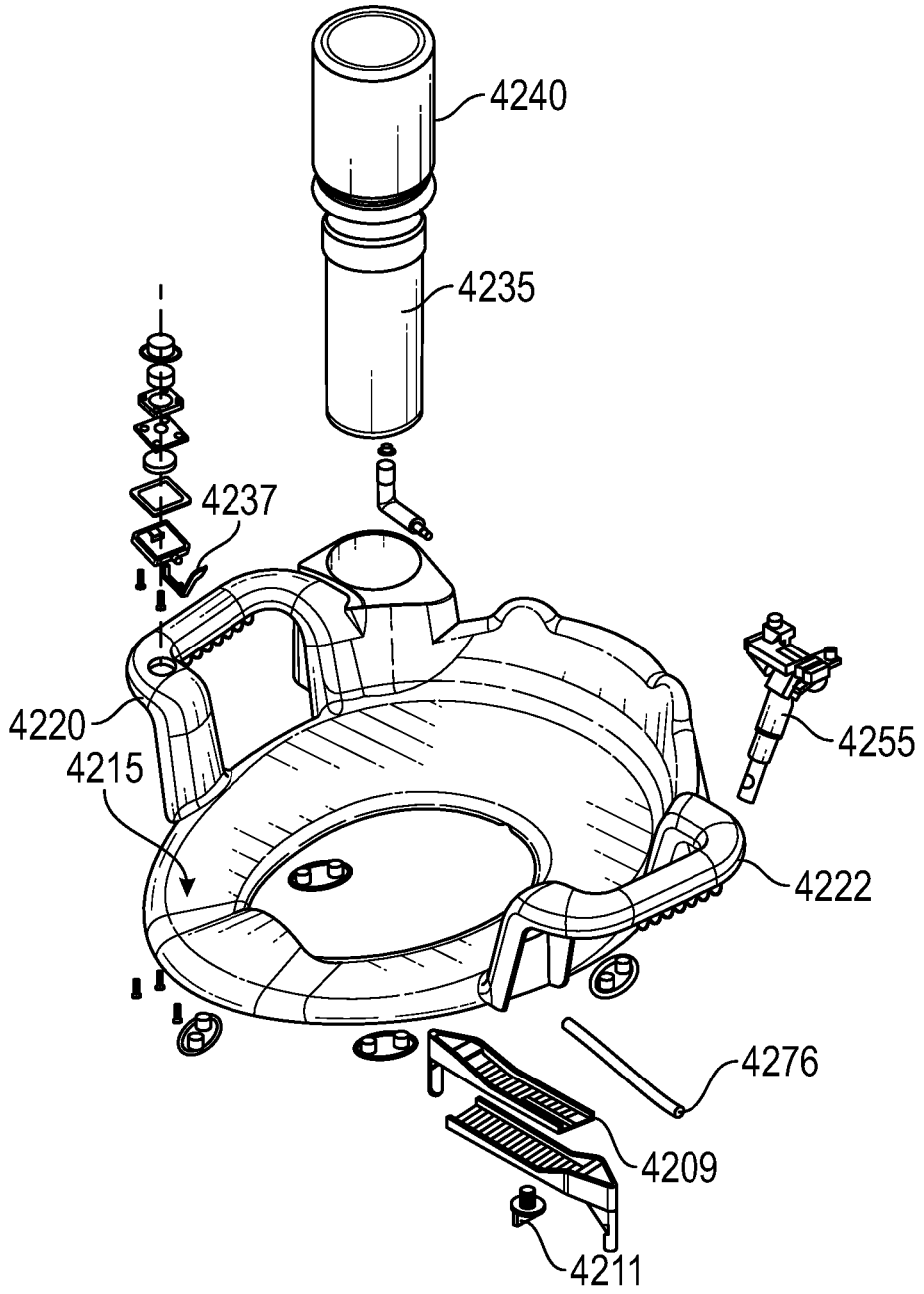
FIG. 42 illustrates the portable child seat bidet, according to an embodiment.

FIG. 42 illustrates the portable child seat bidet 4200, according to an embodiment. FIG. 42 illustrates the vessel 4240, the pump assembly 4235, the nozzle assembly 4255, the bidet seat 4215, the handles 4220, 4222, the adjustable spacer 4209 and knob 4211, and power switch 4237 (or button).

Figure 43A:
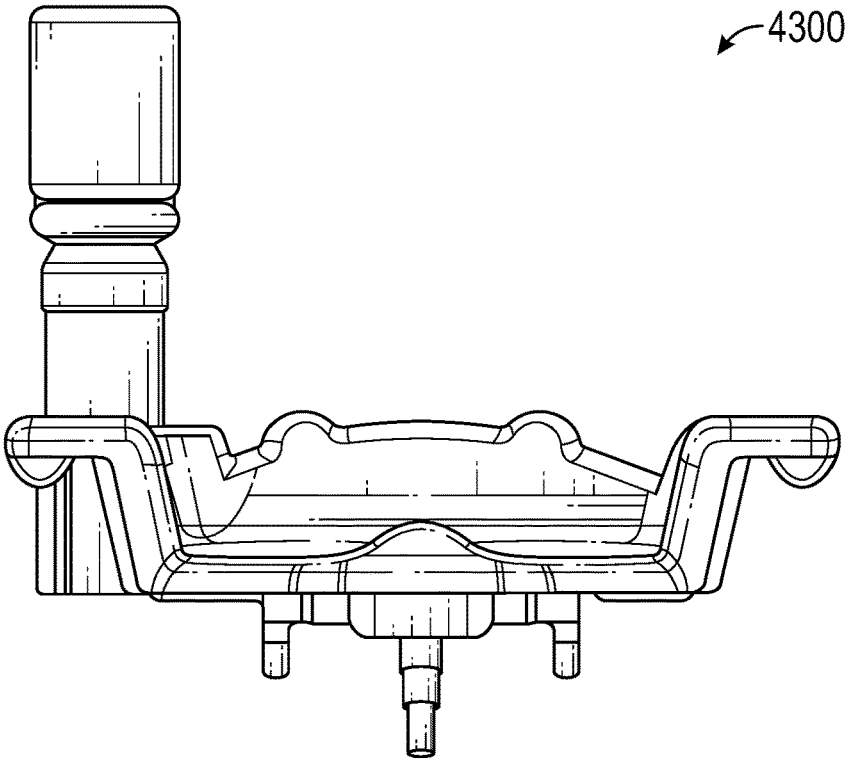
FIG. 43A illustrates a side view of a portable child seat bidet, according to an embodiment.
Figure 43B:
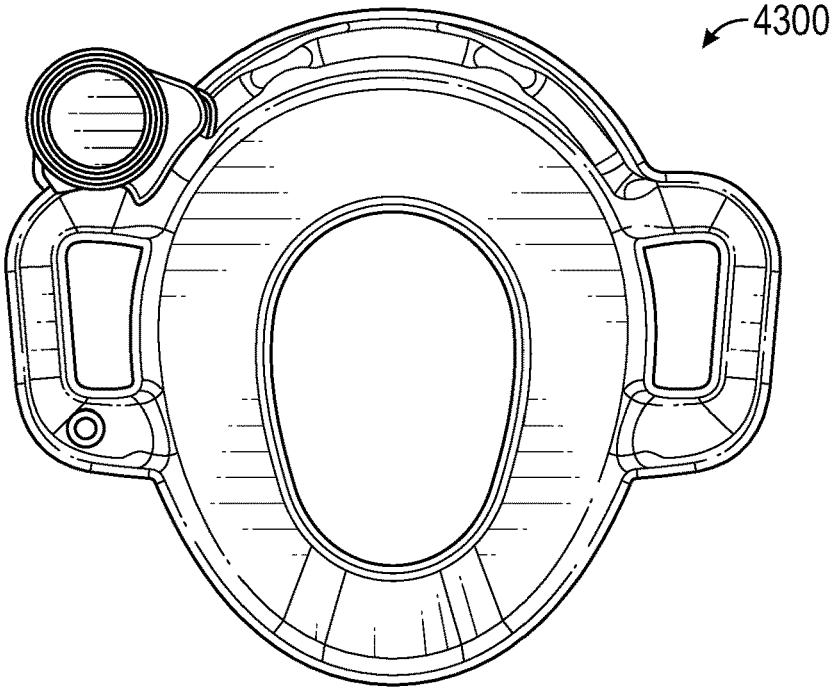
FIG. 43B illustrates a top view of the portable child seat bidet, according to an embodiment.

FIG. 43 illustrates a side view FIG. 43*a* and top view 43*b* of the portable child seat bidet 4300, according to an embodiment.

A feature illustrated in one of the figures may be the same as or similar to a feature illustrated in another of the figures. Similarly, a feature described in connection with one of the figures may be the same as or similar to a feature described in connection with another of the figures. The same or similar features may be noted by the same or similar reference characters unless expressly described otherwise. Additionally, the description of a particular figure may refer to a feature not shown in the particular figure. The feature may be illustrated in and/or further described in connection with another figure.

Elements of processes (i.e. methods) described herein may be executed in one or more ways such as by a human, by a processing device, by mechanisms operating automatically or under human control, and so forth. Additionally, although various elements of a process may be depicted in the figures in a particular order, the elements of the process may be performed in one or more different orders without departing from the substance and spirit of the disclosure herein.

The foregoing description sets forth numerous specific details such as examples of specific systems, components, methods and so forth, in order to provide a good understanding of several implementations. It will be apparent to one skilled in the art, however, that at least some implementations may be practiced without these specific details. In other instances, well-known components or methods are not described in detail or are presented in simple block diagram format in order to avoid unnecessarily obscuring the present implementations. Thus, the specific details set forth above are merely exemplary. Particular implementations may vary from these exemplary details and still be contemplated to be within the scope of the present implementations.

Related elements in the examples and/or embodiments described herein may be identical, similar, or dissimilar in different examples. For the sake of brevity and clarity, related elements may not be redundantly explained. Instead, the use of a same, similar, and/or related element names and/or reference characters may cue the reader that an element with a given name and/or associated reference character may be similar to another related element with the same, similar, and/or related element name and/or reference character in an example explained elsewhere herein. Elements specific to a given example may be described regarding that particular example. A person having ordinary skill in the art will understand that a given element need not be the same and/or similar to the specific portrayal of a related element in any given figure or example in order to share features of the related element.

It is to be understood that the foregoing description is intended to be illustrative and not restrictive. Many other implementations will be apparent to those of skill in the art upon reading and understanding the above description. The scope of the present implementations should, therefore, be determined with reference to the appended claims, along with the full scope of equivalents to which such claims are entitled.

The foregoing disclosure encompasses multiple distinct examples with independent utility. While these examples have been disclosed in a particular form, the specific examples disclosed and illustrated above are not to be considered in a limiting sense as numerous variations are possible. The subject matter disclosed herein includes novel and non-obvious combinations and sub-combinations of the various elements, features, functions and/or properties disclosed above both explicitly and inherently. Where the disclosure or subsequently filed claims recite "a" element, "a first" element, or any such equivalent term, the disclosure or claims is to be understood to incorporate one or more such elements, neither requiring nor excluding two or more of such elements.

As used herein "same" means sharing all features and "similar" means sharing a substantial number of features or sharing materially important features even if a substantial number of features are not shared. As used herein "may" should be interpreted in a permissive sense and should not be interpreted in an indefinite sense. Additionally, use of "is" regarding examples, elements, and/or features should be interpreted to be definite only regarding a specific example and should not be interpreted as definite regarding every example. Furthermore, references to "the disclosure" and/or "this disclosure" refer to the entirety of the writings of this document and the entirety of the accompanying illustrations, which extends to all the writings of each subsection of this document, including the Title, Background, Brief description of the Drawings, Detailed Description, Claims, Abstract, and any other document and/or resource incorporated herein by reference.

As used herein regarding a list, "and" forms a group inclusive of all the listed elements. For example, an example described as including A, B, C, and D is an example that includes A, includes B, includes C, and also includes D. As used herein regarding a list, "or" forms a list of elements, any of which may be included. For example, an example described as including A, B, C, or D is an example that includes any of the elements A, B, C, and D. Unless otherwise stated, an example including a list of alternatively-inclusive elements does not preclude other examples that include various combinations of some or all of the alternatively-inclusive elements. An example described using a list of alternatively-inclusive elements includes at least one element of the listed elements. However, an example described using a list of alternatively-inclusive elements does not preclude another example that includes all of the listed elements. Also, an example described using a list of alternatively-inclusive elements does not preclude another example that includes a combination of some of the listed elements. As used herein regarding a list, "and/or" forms a list of elements inclusive alone or in any combination. Therefore, an example described as including A, B, C, and/or D is should be understood to include, without limitation: A alone; A and B; A, B and C; A, B, C, and D; and so forth. The bounds of an "and/or" list are defined by the complete set of combinations and permutations for the list.

Where multiples of a particular element are shown in a FIG., and where it is clear that the element is duplicated throughout the FIG., only one label may be provided for the element, despite multiple instances of the element being present in the FIG. Accordingly, other instances in the FIG. of the element having identical or similar structure and/or function may not have been redundantly labeled. A person having ordinary skill in the art will recognize based on the disclosure herein redundant and/or duplicated elements of the same FIG. Despite this, redundant labeling may be included where helpful in clarifying the structure of the depicted examples.

The Applicant(s) reserves the right to submit claims directed to combinations and sub-combinations of the disclosed examples believed to be novel and non-obvious. Examples embodied in other combinations and sub-combinations of features, functions, elements and/or properties may be claimed through amendment of those claims or presentation of new claims in the present application or in a related application. Such amended or new claims, whether they are directed to the same example or a different example and whether they are different, broader, narrower or equal in scope to the original claims, are to be considered within the subject matter of the examples described herein.

The invention claimed is:

1. A device, comprising:
a portable child seat bidet comprising:
a seat frame comprising:
a first handle,
a second handle,
a seat back,
a central aperture; and
an adjustable spacer;
a pump assembly comprising:
a pump,
a battery assembly,
a pump assembly threaded end,
a liquid intake,
a liquid outtake,
an air intake,
an air outtake;
wherein the pump assembly has a generally cylindrical geometry with a flattened portion along a vertical length of an exterior wall of the pump assembly;
a vessel configured to hold liquid,
wherein the vessel comprises a threaded end configured to engage the pump assembly threaded end; and
a port comprising:
a port bottom portion,
wherein the port bottom portion further comprises:
a port first aperture,
wherein the port first aperture is configured to anchor the port to the seat frame;
a port second aperture,
wherein the port second aperture is configured to engage the pump assembly liquid outtake, and receive water from the pump assembly liquid outtake;
a port cylindrical wall portion;
wherein the port has a cylindrical geometry with a flattened portion along a vertical length of the port cylindrical wall portion; and
and wherein the flattened portion of the port cylindrical wall portion is configured to engage with the flattened portion of the pump assembly;
tubing,
a bidet assembly comprising:
a bidet assembly housing,
a nozzle,
wherein the tubing is configured to connect the port second aperture to the nozzle allowing water to flow from the vessel through the pump assembly into the port through the tube and out of the nozzle.

2. The device of claim 1, wherein the adjustable spacer:
comprises a knob configured to adjust the length of the adjustable spacer, and
the adjustable spacer is configured to securely mount the seat frame to an adult toilet seat.

3. The device of claim 2 further comprising:
non-slip mats mounted on an underside of the seat frame, and
an anti-slip bezel mounted on a front portion of the underside of the seat frame, wherein the non-slip mats and the anti-slip bezel are configured to mount the seat frame to an adult toilet seat.

4. The device of claim 1 further comprising a power button mounted on a handle of the seat frame,
wherein the power button is wirelessly connected to a main circuit board of the pump assembly.

5. The device of claim 1 further comprising a power button mounted on the pump assembly,
wherein the power button is connected via wires to a main circuit board of the pump assembly.

6. The device of claim 1, wherein the bidet housing assembly is configured to:
receive the tubing from the port;
be mounted on an underside of the seat frame, and
allow the nozzle to rotate vertically in an arc of 180°.

7. The device of claim 1, further comprising a pump assembly hose that extends from the pump assembly air outtake into the vessel,
wherein the pump assembly hose is configured to push air into the vessel and push water into the pump assembly water intake.

8. A device, comprising:
a portable child seat bidet comprising:
a seat frame comprising:
a first handle,
a second handle,
a seat back, and
a central aperture;
a pump assembly comprising:
a pump,
a battery assembly,
a liquid intake,
a liquid outtake,
an air intake,
an air outtake,
a pump assembly anchor;
a vessel configured to hold liquid;
a port comprising:
a port bottom portion,
wherein the port bottom portion further comprises:
a port first aperture,
wherein the port first aperture is configured to anchor the port to the seat frame and receive the pump assembly anchor;

a port second aperture,
wherein the port second aperture is configured to engage the pump assembly liquid outtake, and receive water from the pump assembly liquid outtake;
a port cylindrical wall portion;
tubing,
a bidet assembly comprising:
a bidet assembly housing,
a nozzle,
wherein the tubing is configured to connect the port second aperture to the nozzle allowing water to flow from the vessel to the nozzle.

9. The device of claim 8, further comprising a remote control that connects wirelessly to a main circuit board of the pump assembly,
wherein the pump assembly is controlled wirelessly via the remote control.

10. The device of claim 9, wherein the pump assembly is configured to have:
a strong power setting, and
a weak power setting.

11. The device of claim 10, wherein the pump assembly comprises a main circuit board comprising:
a buzzer configured to notify a user that the pump assembly is activated.

12. The device of claim 11, wherein the pump assembly further comprises a trigger switch,
wherein:
the trigger switch is configured to engage with the port bottom wall, and
when the trigger switch is engaged the pump assembly is activated.

13. The device of claim 11, wherein the bidet housing assembly is configured to provide a range of angles for water output from the nozzle,
wherein the range of angles varies from 90° to 30° C.

14. A device, comprising:
a portable child seat bidet comprising:
a seat frame comprising:
a handle,
a seat back, and
a central aperture;
a pump assembly comprising:
a pump,
a battery assembly,
a liquid intake,
a liquid outtake,
an air intake,
an air outtake,
wherein the pump assembly liquid outtake is located in a pump assembly aperture;
a vessel configured to hold liquid;
a port comprising:
a port bottom portion,
wherein the port bottom portion further comprises:
a port first aperture,
wherein the port first aperture is configured to anchor the port to the seat frame;
a port water intake,
wherein the port water intake is configured to:
engage the pump assembly aperture,
anchor the pump assembly, and
receive water from the pump assembly liquid outtake;
a port cylindrical wall portion;
tubing,
a bidet assembly comprising:
a bidet assembly housing,
a nozzle,
wherein the tubing is configured to connect the port water intake to the nozzle allowing water to flow from the vessel to the nozzle.

15. The device of claim 14, wherein the port cylindrical wall portion comprises apertures configured to increase water flow and air flow.

16. The device of claim 14, wherein the port bottom portion comprises apertures configured to increase water flow and air flow.

17. The device of claim 14, wherein:
the pump assembly has a generally cylindrical geometry with a flattened vertical portion,
the port has a generally cylindrical geometry with a flattened vertical portion, and
the flattened vertical portions are configured to engage and anchor the pump assembly in the port.

18. The device of claim 17, wherein:
the port water intake is positioned off-center from the port bottom portion.

19. The device of claim 18, wherein:
the pump assembly comprises a threaded end,
the vessel comprises a threaded end, and
the threaded ends are configured to engage the pump assembly and the vessel.

20. The device of claim 18, further comprising:
a power button mounted on a handle of the seat frame,
wherein the power button is wirelessly connected to a main circuit board of the pump assembly; and
a remote control wirelessly connected to a main circuit board of the pump assembly,
wherein the pump assembly can be controlled by the power button and the remote control.

* * * * *